US009666075B2

(12) United States Patent
Davies et al.

(10) Patent No.: US 9,666,075 B2
(45) Date of Patent: May 30, 2017

(54) AUTOMATED PARKING SPACE MANAGEMENT SYSTEM WITH DYNAMICALLY UPDATABLE DISPLAY DEVICE

(71) Applicant: ImageMAKER Development Inc., New Westminster (CA)

(72) Inventors: Kenneth William Davies, New Westminster (CA); Aubrey Garry Holmes, Vancouver (CA)

(73) Assignee: ImageMAKER Development Inc., New Westminster (CA)

( * ) Notice: Subject to any disclaimer, the term of this patent is extended or adjusted under 35 U.S.C. 154(b) by 0 days.

(21) Appl. No.: 14/546,857

(22) Filed: Nov. 18, 2014

(65) Prior Publication Data

US 2015/0138001 A1 May 21, 2015

Related U.S. Application Data

(60) Provisional application No. 61/905,746, filed on Nov. 18, 2013.

(51) Int. Cl.
*G08G 1/14* (2006.01)
*G08G 1/017* (2006.01)

(52) U.S. Cl.
CPC ..... *G08G 1/149* (2013.01); *G08G 1/017* (2013.01); *G08G 1/0175* (2013.01); *G08G 1/142* (2013.01); *G08G 1/146* (2013.01)

(58) Field of Classification Search
CPC ..... G08G 1/149; G08G 1/017; G08G 1/0175; G08G 1/146; G08G 1/142; G08G 1/147;
(Continued)

(56) References Cited

U.S. PATENT DOCUMENTS 5,432,508 A 7/1995 Jackson
5,877,704 A 3/1999 Yoshida
(Continued)

FOREIGN PATENT DOCUMENTS

CA 2260925 A1 1/1998
CA 2444315 A1 12/2004
(Continued)

*Primary Examiner* — Anh V La
(74) *Attorney, Agent, or Firm* — Oyen Wiggs Green & Mutala LLP

(57) ABSTRACT

An automated system for managing one or more parking spaces, that includes a vehicle identification detector for detecting vehicles in a parking space area, a dynamically updatable display device mounted in the parking space area, and a computer subsystem that dynamically updates the display device with messages or images to be communicated in real time to the operator of the vehicle that is being parked. The system can be dynamically configured to operate either as a reserved parking system, or as a pay-for-parking system. The system includes an optional billing and payment module that integrates with information provided by the system to manage collection and remittance of parking revenues. The system includes an optional event notification module to manage automatic notification and ticketing of vehicles that are not authorized to be parked in the parking space.

50 Claims, 12 Drawing Sheets

(58) Field of Classification Search
CPC ..... G08G 1/168; G08G 1/141; G08G 1/0969; G08G 1/145; G08G 1/137; B62D 15/028; B62D 15/285; G01S 2015/932; G01S 2013/9314; G07F 17/24
USPC ..... 340/932.2, 933, 937, 942, 995.1, 904, 340/905; 705/5
See application file for complete search history.

(56) References Cited

U.S. PATENT DOCUMENTS

| | | | | |
|---|---|---|---|---|
| 6,340,935 | B1 | 1/2002 | Hall | |
| 6,513,711 | B1 | 2/2003 | Hjelmvik | |
| RE38,626 | E | 10/2004 | Kielland | |
| 7,181,426 | B2 | 2/2007 | Dutta | |
| 7,271,738 | B2 | 9/2007 | Berstis et al. | |
| 8,333,318 | B2 | 12/2012 | Hjelmvik | |
| 2003/0132840 | A1* | 7/2003 | Bahar | G06Q 20/127 340/541 |
| 2004/0068433 | A1 | 4/2004 | Chatterjee et al. | |
| 2006/0015395 | A1 | 1/2006 | Wolfson et al. | |
| 2011/0068739 | A1 | 3/2011 | Smith | |
| 2012/0095812 | A1* | 4/2012 | Stefik | G06Q 10/02 705/13 |
| 2013/0166333 | A1 | 6/2013 | Chang | |
| 2013/0182110 | A1 | 7/2013 | Tziperman et al. | |

FOREIGN PATENT DOCUMENTS

| | | | |
|---|---|---|---|
| CN | 103177601 | A | 6/2013 |
| EP | 0098027 | B1 | 8/1987 |
| EP | 0971320 | A2 | 1/2001 |
| EP | 1255236 | A2 | 11/2002 |
| EP | 1301372 | B1 | 1/2006 |
| EP | 2285085 | A1 | 2/2011 |
| EP | 2299409 | A1 | 3/2011 |
| EP | 2444924 | A1 | 4/2012 |
| WO | 9804080 | A1 | 1/1998 |
| WO | 0141029 | A1 | 6/2001 |
| WO | 0275704 | A1 | 9/2002 |
| WO | 03014882 | A2 | 2/2003 |
| WO | 2004084145 | A2 | 3/2003 |
| WO | 2005109348 | A1 | 11/2005 |
| WO | 2006046233 | A2 | 5/2006 |
| WO | 2007025364 | A1 | 3/2007 |
| WO | 2008030861 | A2 | 3/2008 |
| WO | 2008132411 | A2 | 11/2008 |
| WO | 2011033141 | A1 | 3/2011 |
| WO | 2011151811 | A1 | 12/2011 |
| WO | 2012027437 | A2 | 3/2012 |

* cited by examiner

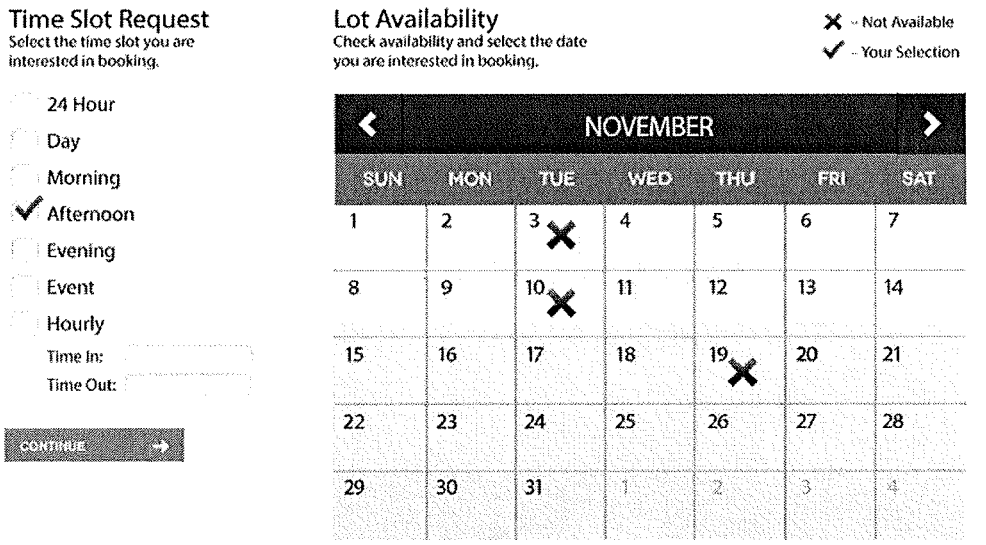
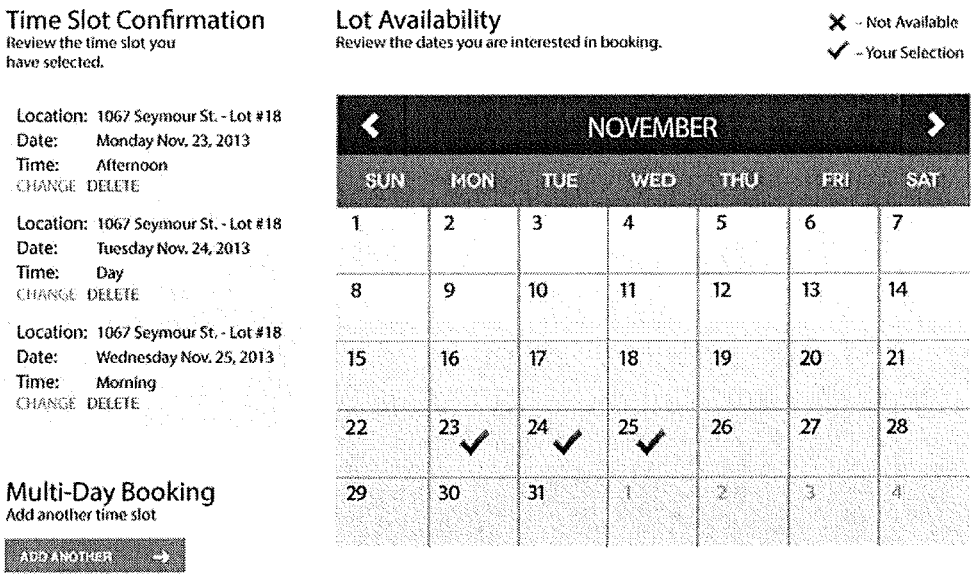
Fig. 7

Personal Information

* First Name: JANE

* Last Name: DOE

* Email Address: ken@imgmaker.com To update your email address, please contact us

* Secret Question: What is your mother's maiden name?

* Secret Answer: ••••••••••

Mailing Address

* Address: 320 2ND ST.

* City: NEW WESTMINSTER

* Country: Canada

* Province/State: British Columbia

* Postal Code/Zip: V3L 2K8

* Phone Number: 604-525-2108 ext

Vehicle Details

Vehicle Nickname:

Vehicle Type: Small Vehicle

Vehicle Make: Subaru (How can I change the vehicle while using this licence plate number?)

Licence Plate #: CTV 997 (How do I update my licence plate number?)

Province/State: British Columbia

Billing Options

Bill Delivery: Email Edit

Billing Method: Pre-Authorized Credit Card Edit

Card Type: Visa

Card Number: **  ** 1236

Expiry Date: 05 / 2017

Fig. 8

| | A | B | C | D | E | F | G |
|---|---|---|---|---|---|---|---|
| 1 | | | | | | | |
| 2 | Date | Time | Space | Event | Identity | Group | Description |
| 3 | 2104-01-27 | 06:00:00 | 2 | sign change | | | Pay parking $3 per hour |
| 4 | 2104-01-27 | 06:00:00 | 1 | sign change | | | Reserved for Mr. Butler |
| 5 | 2104-01-27 | 08:23:32 | 1 | entered | CTV997 | customer | reserved parking customer with in/out |
| 6 | 2104-01-27 | 08:23:32 | 1 | sign change | CTV997 | customer | Welcome Mr. Butler |
| 7 | 2104-01-27 | 08:23:45 | 1 | sign change | CTV997 | customer | Parking Validated |
| 8 | 2104-01-27 | 09:23:32 | 1 | left | CTV997 | customer | left, still reserved |
| 9 | 2104-01-27 | 09:23:32 | 1 | sign change | | | Reserved for Mr. Butler |
| 10 | 2104-01-27 | 10:13:10 | 1 | Entered | CTV997 | customer | reserved parking customer with in/out |
| 11 | 2104-01-27 | 10:13:10 | 1 | sign change | CTV997 | customer | Welcome Mr. Butler |
| 12 | 2104-01-27 | 10:13:32 | 1 | sign change | CTV997 | customer | Parking Validated |
| 13 | 2104-01-27 | 11:23:32 | 1 | left | CTV997 | customer | reservation completed |
| 14 | 2104-01-27 | 11:23:32 | 1 | billing | CTV997 | customer | complete billing |
| 15 | 2104-01-27 | 11:23:32 | 1 | sign change | | | Reserved for pay parking $3.50 per hour |
| 16 | 2104-01-28 | 06:00:00 | 2 | sign change | | | Pay parking $3 per hour |
| 17 | 2104-01-28 | 06:00:00 | 1 | sign change | | | Pay parking $3 per hour |
| 18 | 2104-01-28 | 07:18:12 | 2 | entered | ABC123 | Registered Member | pay parking |
| 19 | 2104-01-28 | 07:18:12 | 2 | sign change | ABC123 | Registered Member | Good morning your excellency |
| 20 | 2104-01-28 | 07:18:32 | 2 | sign change | ABC123 | Registered Member | Parking Validated |
| 21 | 2104-01-28 | 08:18:12 | 2 | left | ABC123 | Registered Member | pay parking |
| 22 | 2104-01-28 | 08:18:12 | 2 | billing | ABC123 | Registered Member | complete billing |
| 23 | 2104-01-28 | 08:18:12 | 2 | sign change | | | Pay parking $3 per hour |
| 24 | 2104-01-28 | 10:18:12 | 1 | entered | unknown | | not recognized |
| 25 | 2104-01-28 | 10:18:16 | 1 | sign change | unknown | | Vehicle not recognized.... Please stand by |
| 26 | 2104-01-28 | 10:18:23 | 1 | override | XYZ999 | general | remote attendant update |
| 27 | 2104-01-28 | 10:18:23 | 1 | entered | XYZ999 | general | pay parking |
| 28 | 2104-01-28 | 10:18:23 | 1 | sign change | XYZ999 | general | Good morning Stanley |
| 29 | 2104-01-28 | 10:18:23 | 1 | sign change | XYZ999 | general | Parking Validated |
| 30 | 2104-01-28 | 12:54:10 | 1 | left | XYZ999 | general | pay parking |
| 31 | 2104-01-28 | 12:54:10 | 1 | billing | XYZ999 | general | complete billing |
| 32 | 2104-01-28 | 12:54:10 | 1 | sign change | | | Reserved for Ms. Johnson |
| 33 | 2104-01-28 | 14:54:10 | 1 | entered | YUI998 | bank customer | reserved parking customer |
| 34 | 2104-01-28 | 14:54:10 | 1 | sign change | YUI998 | bank customer | Good Afternoon Jane |
| 35 | 2104-01-28 | 14:54:20 | 1 | sign change | YUI998 | bank customer | Parking Validated |
| 36 | 2104-01-28 | 18:00:00 | 1 | status change | YUI998 | bank customer | reservation completed |
| 37 | 2104-01-28 | 18:00:00 | 1 | entered | YUI998 | bank customer | pay parking |

Fig. 9

AUTOMATED PARKING SPACE MANAGEMENT SYSTEM WITH DYNAMICALLY UPDATABLE DISPLAY DEVICE

RELATED APPLICATIONS

This application claims the benefit of the priority of U.S. provisional patent application No. 61/905,746 filed 18 Nov. 2013, which is hereby incorporated herein by reference.

TECHNICAL FIELD

The present technology is in the field of parking management. Particular embodiments relate to systems, apparatus and methods for allocating and reserving parking spaces.

BACKGROUND

As the cost of real estate in cities rises, so too does the cost of providing parking. As the cost of providing parking spaces rises, the ratio of new development to new parking spaces in cities decreases. For those individuals or businesses owners that require parking to be available for themselves, their employees, or their customers, often their only option is to acquire or build one or more reserved parking spaces, which then sit empty and unused when a reserved vehicle is not parked there.

There is a general desire for systems, apparatus and methods that can:

a) Provide a simple intuitive method for allocating and reserving parking spaces.
b) Automatically recognize the vehicle identity without the need for human intervention.
c) Communicate complex messages back to the vehicle operator to direct parking activities.
d) Switch to a pay parking space management system when there is no active reservation in place.
e) Automatically handle billing, identification of parking violations, and ticketing at a minimum cost to the owner or manager of the parking space(s).

SUMMARY

Particular aspects relate to a parking space management system for managing use of a parking area comprising at least one parking space. The system incorporates one or more database repositories containing a first database storing vehicle identification information uniquely identifying vehicles authorized to occupy the at least one parking space and a second database storing parking usage rules governing use of the at least one parking space; a parking space monitor comprising a vehicle detection and recognition system responsive to the presence of a vehicle in a parking space in the parking area; a dynamically updatable display device visible to the vehicle operator at or near the parking space; and a computer subsystem which processes input from the parking space monitor and the first and second databases and generates output specific to the vehicle for display on the display device.

The parking space management system may include an optional billing module, an optional notification module, and an optional video surveillance module. The system can be used to monitor, direct, and manage a parking space. Some applications provided by this system include the ability to manage reserved parking activities and paid parking activities (and the ability to switch between reserved parking and paid parking modes); the ability to efficiently monitor and police the use of the parking space in order to detect parking violations; the ability to dynamically adjust the parking space usage rules to restrict usage to different pre-defined groups of vehicles; and the ability to dynamically adjust the parking space rental rates for each managed parking space, based either on parking space location, time of day, parking lot usage, or other measurable indicators.

More specifically, an automated system is provided for managing parking within a parking space which includes:

a) A dynamically updatable display device, situated within, or near to the parking space area, that displays personalized messages to the vehicle operator who is about to park, is parking, has now parked, or is now leaving the parking space.
b) An automated vehicle detection and recognition system, which may use one or more systems or devices for identifying a vehicle such as a license plate recognition (LPR) system, an automatic number plate recognition (ANPR) system, an image capture device, a RFID reader, a Bluetooth communication device, a WiFi communication device, a QR Code identification system, a barcode identification system, a vehicle profile recognition system and a vehicle color recognition system.
c) An integrated computer system configured to display text and images on the dynamically updatable display device, based on matching the vehicle identity against information stored in an updatable database.
d) One or more computer interface elements that allow an operator to dynamically update the database information.
e) An optional notification system that automatically sends event notifications to authorized agents, including the vehicle owner, parking space owner, and parking lot manager, regarding changes to the parking space status.
f) One or more optional video security cameras that allow an authorized person to view the parking area from an external Internet connected location.
g) An optional billing module that automates the collection and disbursement of parking revenue.
h) An optional enforcement module that automatically issues parking tickets, and sends out status alert messages to authorized enforcement agents, including the ability to request that a tow-truck be dispatched.

In one aspect a computer-implemented method for automated management of a parking space in a parking area is also provided, including the steps of:

a) Determining by a parking space monitor comprising a vehicle detection and recognition system an identity of a vehicle parked in the parking space;
b) Using a computer system, comparing the recognized vehicle identity against a list of known vehicle identities that are explicitly allowed, or explicitly not allowed, to park in the parking space during defined times in the day; and
c) Updating a parking space display device to provide real-time feedback to the vehicle operator regarding the vehicle parking status, including the display of personalized messages or images that are matched to the vehicle identity.

BRIEF DESCRIPTION OF THE DRAWINGS

FIG. 7 shows an exemplary web page interface which may be used by a registered user to look for and reserve one or more parking spaces.

FIG. 8 shows an exemplary web page interface which may be used for entering information into a web-based server or cloud-based server to register a vehicle in the parking space management system.

FIG. 9 shows a user interface display of sample contents of a parking space events database.

DETAILED DESCRIPTION OF THE INVENTION

Definitions

The terms "parking space" or "parking spot" refer herein to a location in which one vehicle is able to park for a predetermined period of time. The parking space may contain the installed parking space management system equipment according to embodiments described herein.

The term "parking area" refers herein to an area which comprises one or more parking spaces. A parking area may be, for example located in a garage, a building, a house, a public facility, a municipal area, or a street. As used herein a "parking lot" is one example of a "parking area".

The term "vehicle operator" refers to a person or autonomous device in command of the vehicle, who is responsible for driving and parking the vehicle. The vehicle operator may be the same or different than the vehicle owner.

The term "dynamically updatable display device" refers to a device that is capable of displaying messages to a user, controlled in real-time by a computer that is generating the messages. A feature of a dynamically updatable display device is that messages longer than the width of the display area can be scrolled either vertically or horizontally, so as to be clearly readable at a reasonable distance. The display device text may be visible in a variety of lighting conditions including darkness, low light, bright light, or full sunlight. The display device may comprise an LED (light-emitting diode) display panel. The display device may be orientated either horizontally or vertically.

The term "group" refers to a collection of vehicle identities that are all considered to have the same collective property. For example, such property may be that the vehicles are collectively authorized by the system to park in one or more monitored parking spaces (e.g. on a first-come, first-served basis). For example, all the members of a fitness club could collectively belong to a designated group, and parking is then reserved for members of the designated fitness group. A group can consist of zero, one, or multiple vehicles. A single registered vehicle can be included in more than one group. All vehicles are assigned to at least one group. The default group of one is named by the license plate number. The collection of all registered vehicles known to the system is collectively referred to herein as the "registered members" group.

Reference will now be made in detail to embodiments of the invention, examples of which are illustrated in the accompanying drawings. Wherever possible, the same reference numbers will be used throughout the drawings to refer to the same or like parts.

Figure 1:
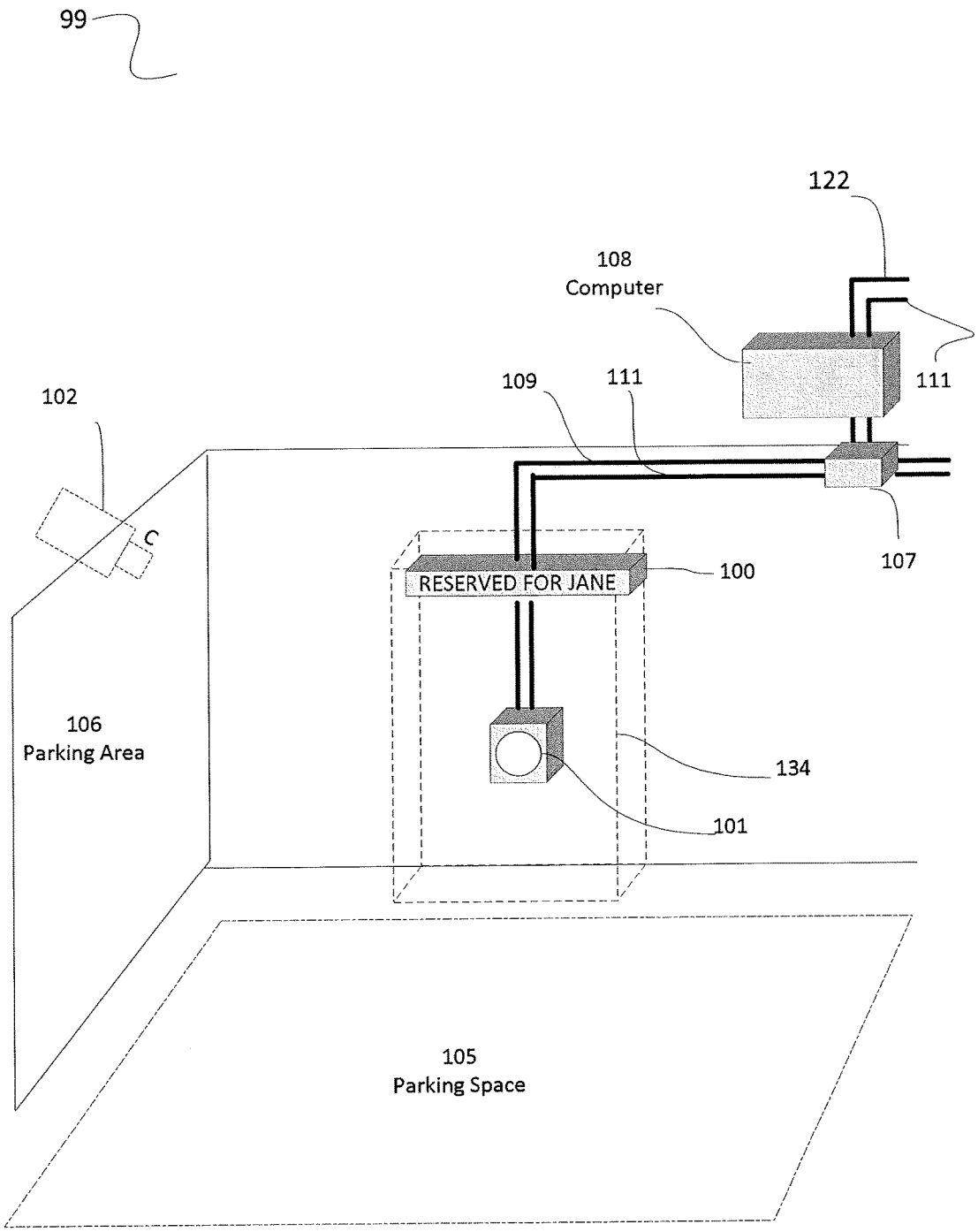
FIG. 1 shows a parking area containing one parking space. The parking area contains a parking space management system, which includes an optional surveillance camera. The display panel shows the scrolling text: "Reserved for Jane".
Figure 2:
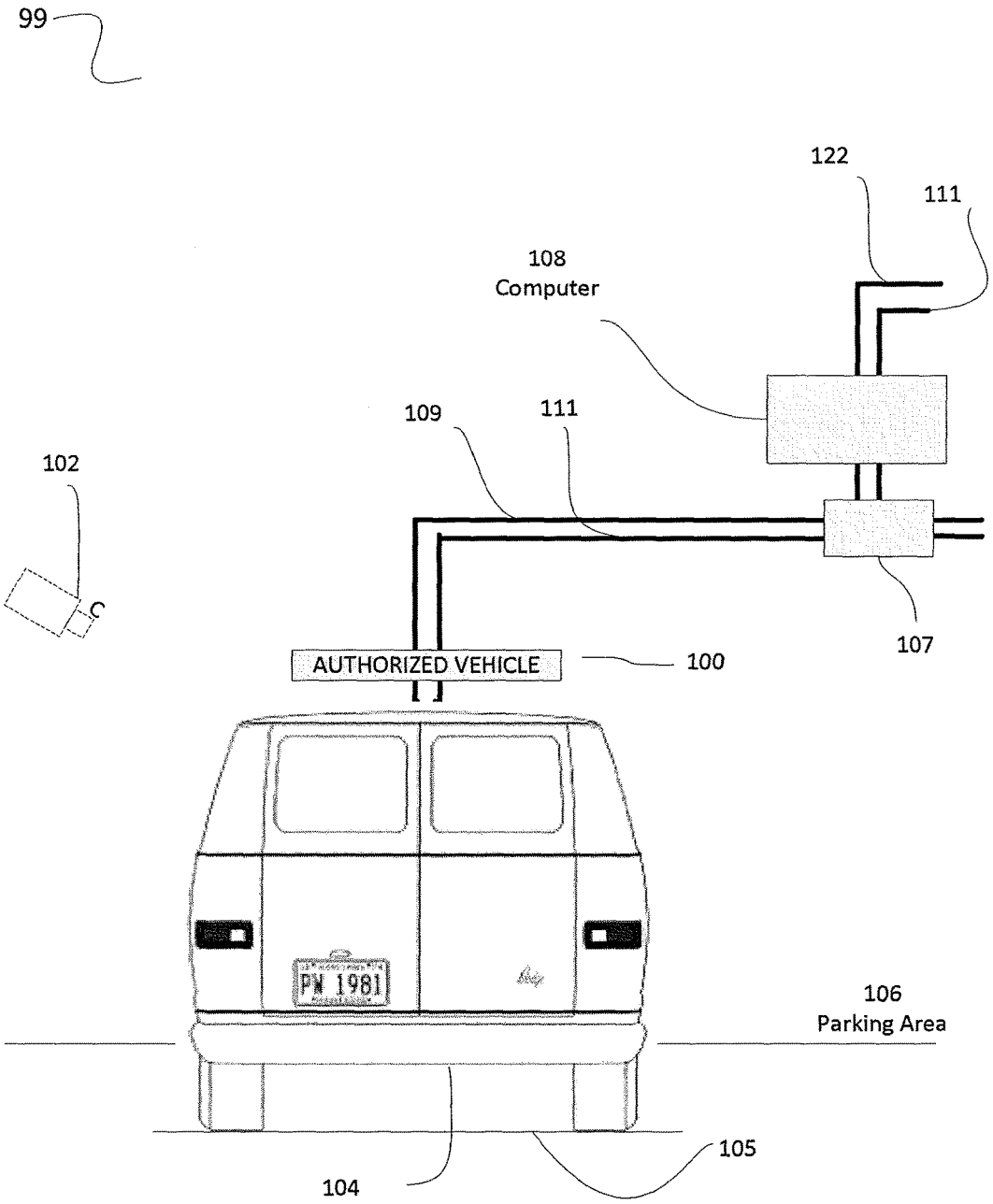
FIG. 2 shows the FIG. 1 parking area with a vehicle parked in the parking space. The parking space management system display panel shows the scrolling text: "Authorized Vehicle".

FIG. 1 shows a parking space management system (99), comprising a dynamically updatable display device (100), a parking space monitor comprising a vehicle detection and recognition system (101), and one or more optional remote cameras (102) installed in or near a parking space area (106), such as a parking lot. In FIG. 1 the parking space (105) located in parking space area (106) is shown empty (i.e. no vehicle (104) is present), and the dynamically updatable display device (100) indicates that the reserved status of the parking space is "Reserved for Jane". In FIG. 2 a vehicle (104) is present in parking space (105) and display device (100) denotes an "Authorized Vehicle".

The vehicle detection and recognition system (101) may consist of various hardware and software devices used to collect information about the parked vehicle (104). Information collected can include, but is not limited to: captured image data, RFID signatures, proximity information, motion information, Bluetooth signatures, WiFi signatures, QR Codes, barcodes, vehicle color, vehicle profile, and license plate number. In some embodiments system (101) may comprise a proximity sensor, motion detector and/or a camera for capturing images of the vehicle's license plate so that the vehicle can be identified by a license plate recognition module (116), as described below with reference to FIG. 4. The proximity sensor and motion detector may be implemented by hardware, or they may be implemented by software (e.g. software comparing successive images captured by the camera). Further details of the vehicle detection and recognition system (101) are provided below with reference to FIG. 5.

The one or more optional remote video surveillance cameras (102) may be mounted in the parking space area (106) to provide a wider angle view of the parking space (105) for security monitoring purposes.

The dynamically updatable display device (100), vehicle detection and recognition system (101), and remote cameras (102) are connected to a computer (108) via one or more of a network cable, serial cable, or USB cable (109), or wireless connection (not shown). As described herein, computer (108) may be located in parking area (106) or at a location proximate to or remote from parking area (106). The various components of the parking space management system (99) are also connected to a power source using various power cables (111). Multiple parking space installations may be daisy-chained to each other through a network switch (107) so as to minimize the number of cables connected to the computer (108).

Figure 4:
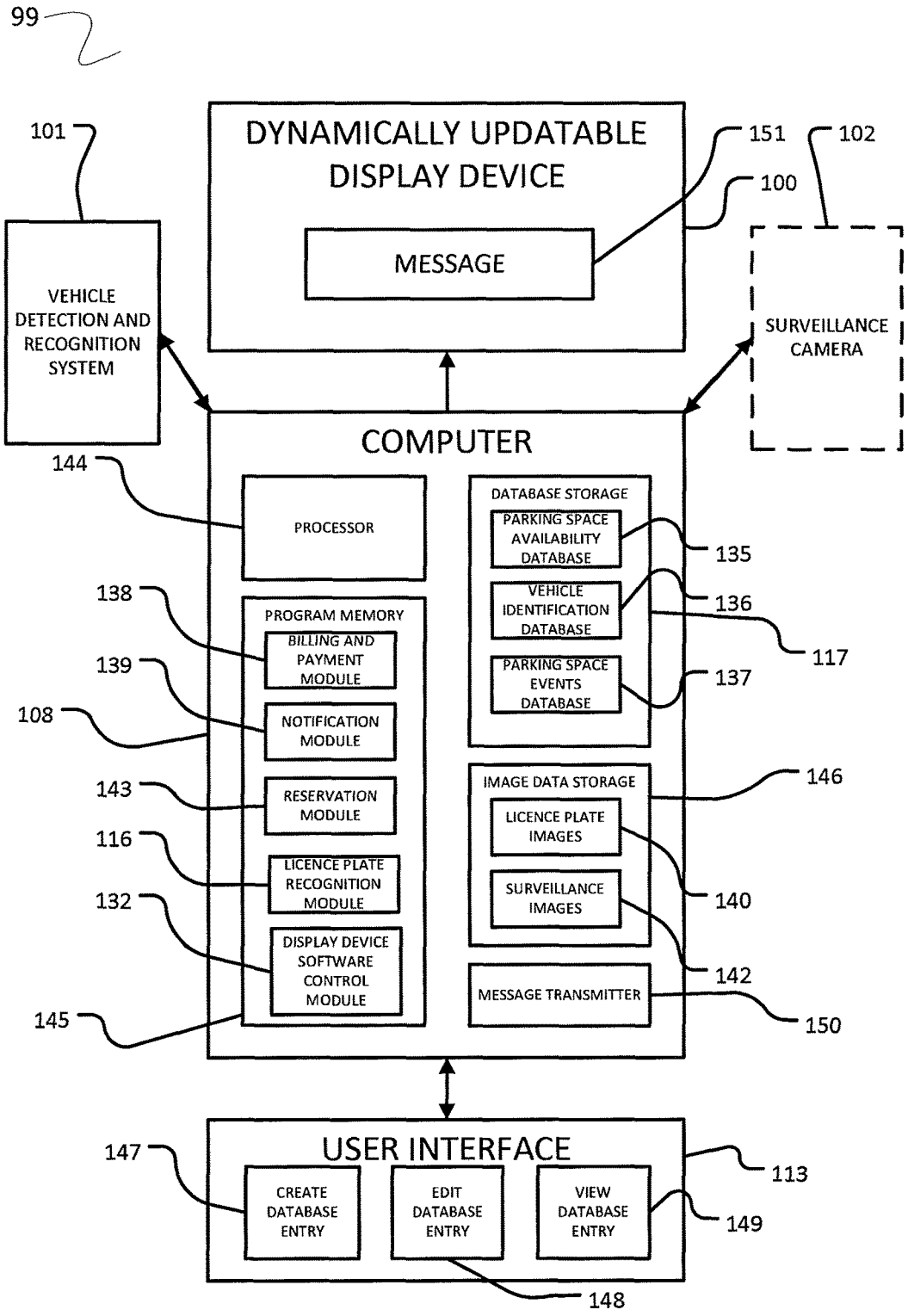
FIG. 4 is a schematic diagram of a parking space management system according to one embodiment that may be used with the FIG. 1 parking area.

As shown in FIG. 4, computer (108) is responsible for running the license plate recognition module (116). The computer (108) is also responsible for storing the various databases (117) used in managing parking space (105). The computer (108) also stores image and vehicle data from the vehicle detection and recognition system (101) and remote cameras (102), and runs the display device software control module (132) that updates the dynamically updatable display device (100). The computer (108) may also provide a computer-implemented user interface (113) to allow a local, network connected, wirelessly connected, or Internet connected user to create, view and edit the contents of the various databases (117).

As indicated above, in one embodiment, the computer (108) may be installed in the parking space area (106). Each parking space (105) within parking space area (106) may have its own individual computer (108). The computer (108) may alternatively be stored near to, but separate from the parking space area (106), and may be connected to one or more parking spaces (105). The computer (108) may for example be stored inside a secured near-by building so as to limit unauthorized physical access. The computer (108) may also be stored remotely in a geographically separate location from the parking space area (106). In some embodiments the computer (108) may be connected to a computer network to allow local remote access and control. The computer (108) may also be connected to an Internet connection to allow remote access and control.

The dynamically updatable display device (100), vehicle detection and recognition system (101) and remote cameras (102) may be weatherproofed for outside use (e.g. by installing inside a weatherproof enclosure). If the parking space area (106) is situated inside a protected parking area, then the dynamically updatable display device (100) vehicle detection and recognition system (101) and remote cameras (102) may be installed without the weatherproof enclosure.

The dynamically updatable display device (100) and vehicle detection and recognition system (101) may also be contained within a protective parking space management unit (134) that secures the equipment to a fixed object, thus reducing the risk that the equipment may be damaged through vandalism or accidental physical contact with people or vehicles.

As shown in FIG. 1, one position for the vehicle detection and recognition system (101) is a few feet off of the ground at the vehicle front facing area of the parking space (105).

One position for the dynamically updatable display device (100) is at or slightly above eye level of the vehicle operator (127), at the vehicle front facing area of the parking space (105).

Example messages (151) that might be displayed on the dynamically updatable display device (100) if the parking space (105) is empty include:

"Reserved for registered customers only"

"Reserved for employees only"

"Reserved for the BOSS"

FIG. 2 shows a parking space (105) with a vehicle (104) parked in it. The vehicle license plate has been read and validated by the license plate recognition module (116) (FIG. 4) as belonging to the 'office' group. As the current parking restriction allows vehicles (104) from the office group to park in the parking space (105) at any time of day or night, the dynamically updatable display device (100) now reads:

"Authorized Vehicle".

Example messages (151) that might be displayed on the dynamically updatable display device (100) if the parking space (105) is occupied include:

"Your vehicle has been validated. You may park here for up to one hour"

"Your vehicle is not recognized. Please find another place to park"

"This vehicle is illegally parked. A tow-truck has been called"

"The BOSS is IN"

In an alternate embodiment, if the parked vehicle (104) is authorized, and the preferred language of the vehicle operator (127) is Chinese, then the language of the message (151) on the dynamically updatable display device (100) may be changed to be displayed in Chinese rather than English for this particular vehicle (104).

Figure 3:
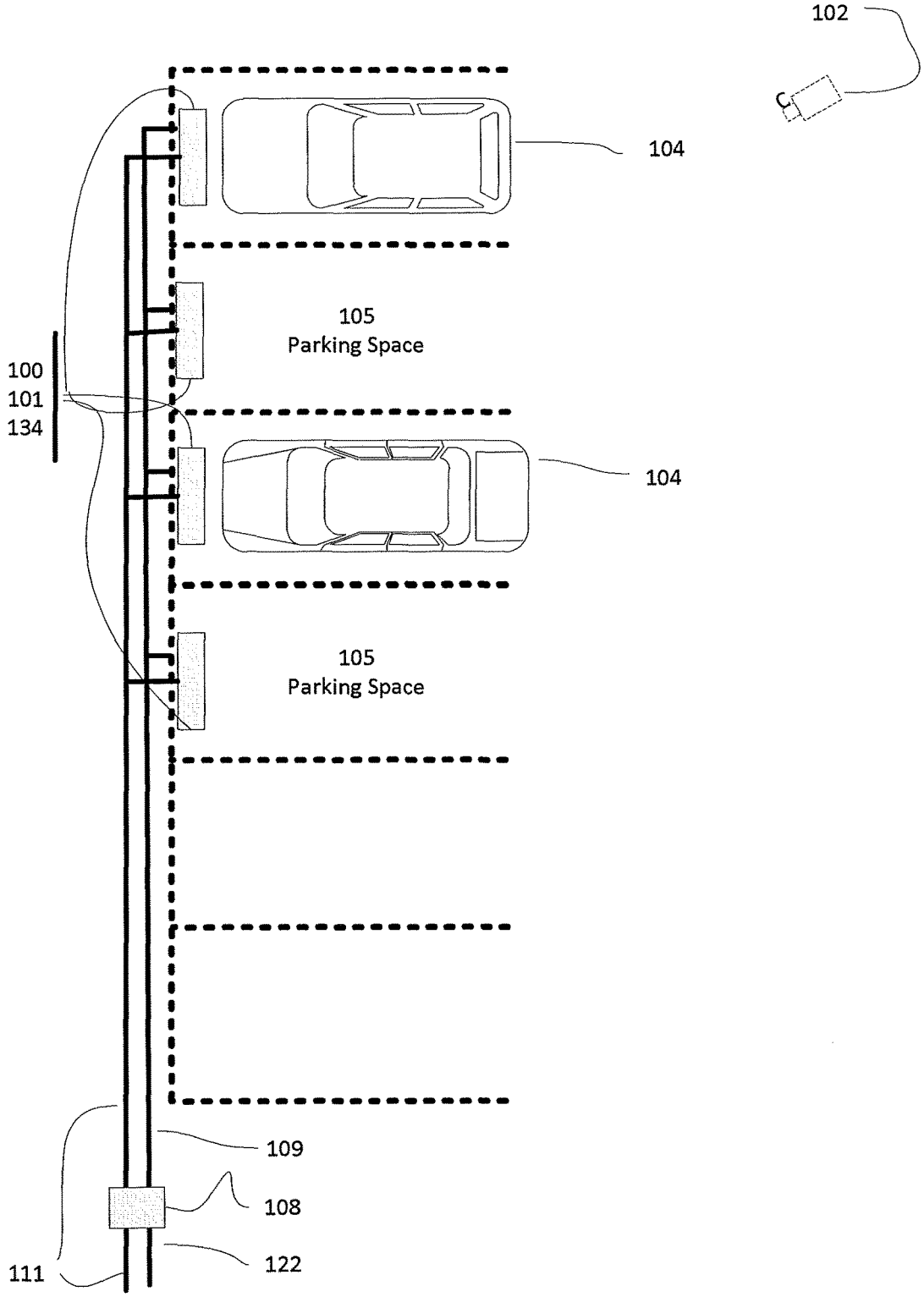
FIG. 3 is a schematic diagram of a parking lot with six parking spaces. The parking space management system is installed in four of the six parking spaces. An optional surveillance camera is also installed in the vicinity of the parking lot, capable of monitoring all four parking spaces.

FIG. 3 shows a schematic of a parking lot that contains six parking spaces (105), four of which are managed by a parking management system (99). Each managed parking space (105) has its own dynamically updatable display device (100) and vehicle detection and recognition system (101) housed within a protective unit (134). An optional security camera (102) with a wide angle view is installed at the end of the four parking spaces (105), and may be used as a remote Internet accessible video monitor.

The dynamically updatable display device (100), vehicle detection and recognition system (101) and remote camera (102) are connected through network switches and network cables (109), or by wireless connection, to the computer (108). As will be appreciated by a person skilled in the art, the wireless communication may take a variety of forms, including WiFi, radio, cellular packet communication or other machine to machine communication.

FIG. 4 shows the computer software components of a computer (108) integrated in the parking space management system (99) of FIG. 1. The database collection (117), which may be stored locally on the computer (108) or on a remote server accessible to computer (108), is comprised of three distinct databases: the parking space availability database (135), the vehicle identification database (136), and the parking space events database (137). The database collection (117) stores all the necessary information used by the parking space management system (99) to manage the parking space(s) (105). In particular, database (135) stores information regarding the set of managed parking spaces (105); database (136) stores information relating to the set of known vehicles (104); and database (137) stores information relating the set of parking events in respect of each of the parking spaces (105).

A number of software modules for implementing parking space management functions may be stored in a program memory (145) on the computer (108) (FIG. 4). The license plate recognition module (116) is responsible for taking the generated images from the vehicle detection and recognition system (101), and extracting license plate number information from the images. Additional data that might be extracted and stored from the vehicle detection and recognition system (101) and/or the license plate recognition module (116), include proximity information, motion information, color of the vehicle, and/or the make and model of the vehicle, QR Code encoded information, barcode encoded information, along with any identifying RFID signatures, Bluetooth signatures, and WiFi signatures. In one embodiment, some vehicle identification data may be stored in the parking space events database (137).

The display device software control module (132) is responsible for sending the text message strings and graphics to the dynamically updatable display device (100). The dynamically updatable display device (100) supports multiple display effects, including text scrolling. The text strings may be displayed in a number of language and character fonts. The dynamically updatable display device (100) may also support animated graphics, such as the image of a tow-truck pulling a vehicle across the area of the display device. The dynamically updatable display device (100) may also support the use of clocks, count down timers, or elapsed time displays to indicate amount of time the vehicle (104) has been parked.

Figure 6:
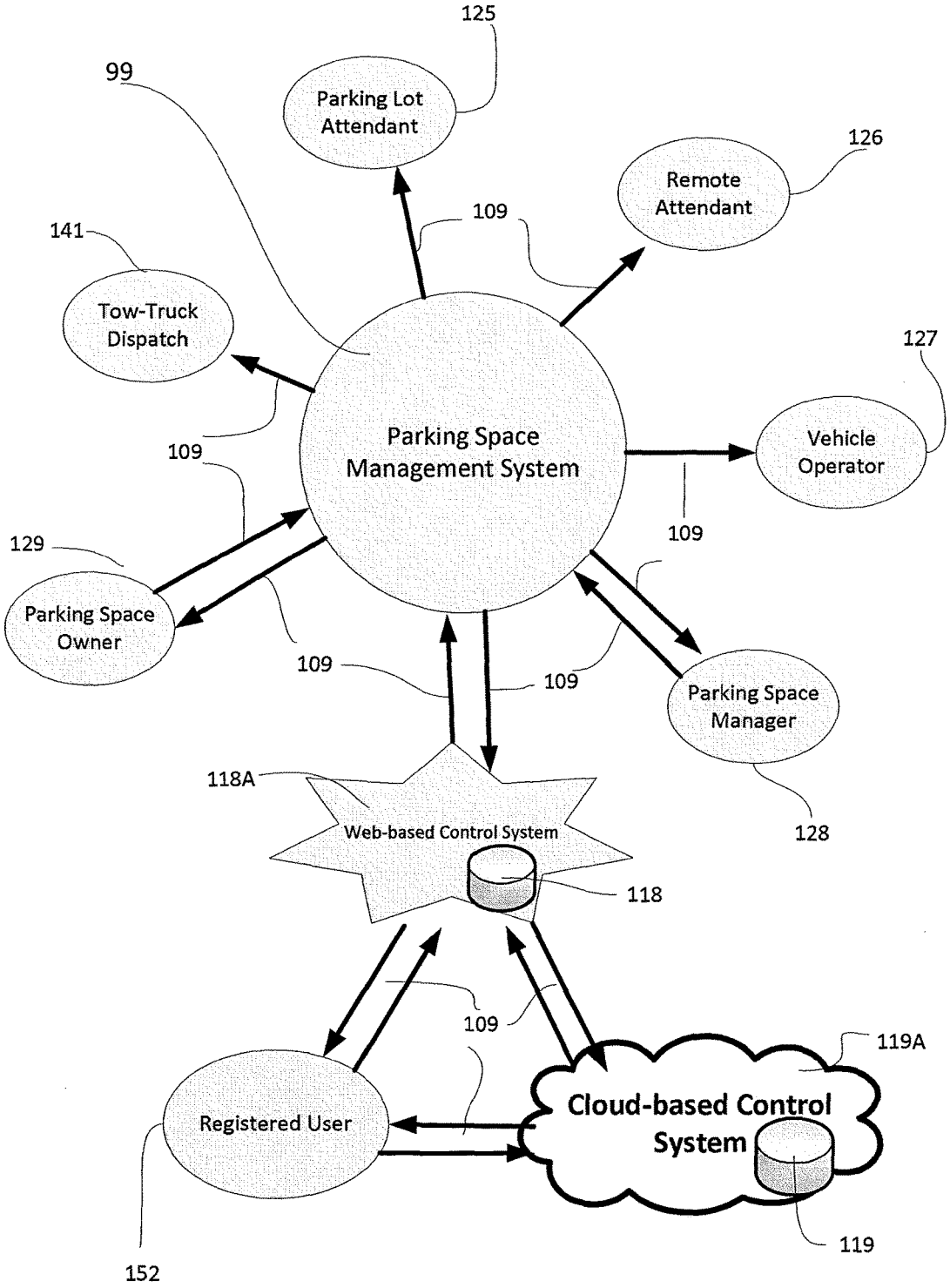
FIG. 6 is a schematic showing the inter-connections between a parking space management system, related agents, a web-based control system, and a cloud-based control system.

The billing and payment module (138) is responsible for accessing the parking space events database (137) to identify billing events. Billing events are created by accessing the parking space availability database (135), vehicle identification database (136), and parking space events database (137) to generate billing information, then automating the process of billing the owner of the parked vehicle (104), and remitting the amount collected to the appropriate person or entity. Some of the various persons or entities in communication with parking space management system (99) as user agents are shown in FIG. 6. In some embodiments payments could be remitted to the parking space manager (128), the parking space owner (129), the parking lot owner (not shown), the parking space management system operator (not shown), and the various tax authorities.

The notification module (139) monitors the parking space activities through the parking space events database (137), and sends out event notifications based on status changes to the parking space (105). Event notifications may include, but are not limited to: a) information about what vehicle has just entered, or exited the parking space (105); b) identification of parking violations; c) billing issues; d) equipment failure issues; e) messages displayed to the vehicle operator (127) regarding expired parking; and f) other parking status behaviour items that may require a parking lot attendant (125) to initiate an investigation. Event messages may be sent via email, text message, pre-recorded voice mail, through a web interface, through a phone app, by pager, or directly displayed to the dynamically updatable display device (100).

The reservation module (143) is the software application responsible for coordinating the activities of the various software and database modules required to run the parking space management system (99).

The message transmitter module (150) is responsible for sending messages generated by the notification module (139) to the various authorized user agents. Message formats include wireless instant message, Internet based email, recorded voice message, and machine-to-machine transmissions.

In one embodiment computer (108) stores license plate images (140) and/or surveillance images (142) collected from the parking space (105), or the larger parking area (106), in bitmap image and video formats in data storage (146) which functions as an image repository. License plate data images (140) are captured from the parking space vehicle detection and recognition system (101). Surveillance images (142) are captured from video surveillance cameras (102). Images (140), (142) can be accessed by authorized agents, either in real-time, or by reviewing the historically stored data. Images stored in data storage (146) may also be sent as email by the event notification module (139). Images (140), (142) may be routinely purged to avoid overflowing the storage capacity of data storage (146).

The computer-implemented user interface (113) shown in FIG. 4 is used to set up, review, and edit the database contents (117). In one embodiment the interface (113) includes the following modules: create database entry (147), edit database entry (148) and view database entry (149). The interface implementation may vary considerably depending on what hardware the interface is being implemented on. The local database collection (117) may also be synchronized to a web accessible database used to manage one or more parking space computers (not shown on this diagram).

In particular embodiments, the information stored in the parking space availability database (135) includes: 1) identification information about each parking space (105), possibly including the GPS location, and a physical description. 2) A list of defined group identifiers. Example group identifiers include: Owner, customer, employee, club member, guest, special event, family member of owner, friend of owner, medical personnel, commercial delivery, commercial pick-up, handicapped, electric vehicle, license plate specific, and additional custom defined groups. A special 'parking violator' group is defined for repeat parking offenders. 3) Calendar entries indicating which groups are allowed to park in the reserved space during which minutes, hours and days in the year. 4) Parking Space contact information, including the owner details, lot manager details, and tow truck dispatch details. 5) Payment remittance information—indicating what amounts collected are to be remitted to the owner, the lot manager, the parking space management system operator, and amounts to be remitted to the tax authorities. 6) Captured images and videos from the surveillance cameras (102) for each monitored parking space (105).

In particular embodiments, the information stored in the vehicle identification database (136) includes: 1) Vehicle identification information, including vehicle manufacturer, vehicle model, vehicle year of manufacture, vehicle color, any QR codes, RFID signatures, Bluetooth signatures, barcode signatures, and vehicle license plate number. 2) Vehicle operator contact information, including name, address, phone number, cell number, email address, preferred language, and alternate contact information. 3) Vehicle operator billing information, including the billing name, billing address, billing email address, phone number, credit card type, credit card number, credit card expiry date, and any additional credit card identification numbers. 4) Unique message strings that are sent to the display device (100) on recognition of the vehicle (104). The strings may be sent at different timed intervals after the vehicle (104) has been parked. 5) The set of groups, referenced by the parking space availability database (135), that the vehicle (104) belongs to. Note: A vehicle (104) must belong to at least one group, but may belong to more than one group.

The information stored in the parking space events database (137) may include a separate record for each recorded parking event identified per managed parking space (105). The event record includes the parking space identification number, the vehicle identification number, time of day, type of event, the group that the vehicle was recognized as belonging to, and any additional information, such as the charged hourly parking rate. Example generated events include: 1) A new vehicle (104) is entering the parking space (105). 2) The current parked vehicle (104) is leaving the parking space (105). 3) The vehicle identity is recognized. 4)

The vehicle identity is not recognized. 5) What message string was sent to the display device (100). 6) Any billing or notification events generated.

The billing and payment module (138) uses the contents of the parking space events database (137) to look up vehicle information from the vehicle identification database (136) and parking space availability information from the parking space availability database (135) to generate billing information.

The notification module (139) uses the contents of the parking space events database (137) to generate event notifications.

FIG. 5 shows various views of a parking space management unit (134) in different configurations.

Figure 5A:
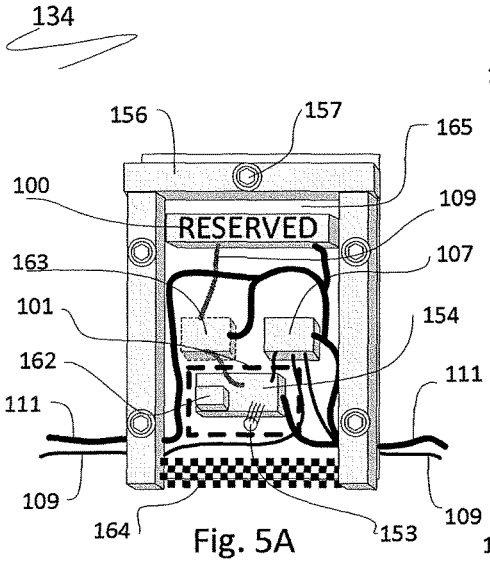
FIGS. 5A, 5B, 5C, 5D and 5E (collectively, FIG. 5) show various views and configurations of a parking space management unit that contains a dynamically updatable display device, network switches, and vehicle detection and recognition equipment. The parking space management unit may be enclosed in a protective housing device.

FIG. 5A depicts a parking space management unit (134) which has a flat base element (165) to which is attached three square steel tube frames (156). In the enclosed space on the base element (165) are attached a dynamically updatable display device (100), an optional network switch (107), an optional USB hub or switch (163), and a vehicle detection and recognition system (101) consisting of a single board computer (154), a camera element (153) and a solid state storage device (162) connected to the single board computer (154). The solid state storage device (162) may consist of, for example, an SSD memory card or a USB memory stick.

Power cables (111) and network connectivity cables (109) enter on one side of the unit (134), and leave out the other. Multiple parking space management units (134) can be daisy chained together by connecting the cables of units (134) together. If the device is connected wirelessly through a WiFi dongle (not shown), then there is no need for connectivity cables (109).

Power cables (111) power each of the internal components at the appropriate voltage. A network cable (109) or WiFi dongle (not shown) provides network connectivity. The network cable (109) is connected to the network switch (107), which in turn is connected to the single board computer (154).

A network cable (109) may also be used to connect the display device (100) to the network switch (107). Alternately, a USB or serial cable can be used to connect the display device (100), either directly, or through the optional USB hub (163), to the single board computer (154). If a USB cable is used, power and network connectivity may be provided in the same cable.

At the bottom of the base element (165) is attached a semi-permeable protective mesh (164). The mesh (164) allows air to circulate through the unit (134), but prevents foreign objects from entering.

In an alternate embodiment, a second single board computer, camera element, and solid state drive (SSD card) may be installed at a different location within parking space management unit (134), such as lower down in an elongated unit, to provide a second redundant vehicle detection and recognition system (101), capable of viewing obscured license plates that the top camera element (153) cannot properly resolve.

The vehicle detection and recognition system (101) (bounded by dashed lines in FIG. 5A) captures images from the camera (153), processed by software running in the central CPU of the on-board computer (154), and saved to the solid state storage device (162). Captured images are saved to the solid state storage device (162) in a continuous looped queue structure, where the most recently captured image over-writes the oldest captured image. Images may be continuously captured and saved at up to thirty frames a second. In some embodiments images are saved at a speed of five frames a second, or in other embodiments as low as one frame a second. Captured images saved to the solid state storage device (162) may be accessed by computer (108), and processed by the license place recognition module (116) to determine the vehicle identity. High speed image capture may be useful if the license plate is no longer visible when the vehicle (104) is parked, as there may only be a very small window of time when the license plate is clearly visible to the vehicle detection and recognition system (101) (e.g. the license plate is only fully visible as the moving vehicle (104) is entering the parking space (105)).

Captured images may be processed by the on-board computer (154) to identify differences between previously saved images in order to detect motion and proximity information. For example, if motion is detected in the downward or upwards direction, then this could indicate that a vehicle (104) is likely entering or leaving the parking space (105). If there is no motion, but the current foreground of the image (near the bottom of the image frame) is significantly different from a reference image (captured when the parking space (105) was empty), then this could indicate that there is a stationary vehicle in proximity to the vehicle detection and recognition system (101), and that the parking space (105) is likely occupied by a vehicle (104).

In addition or in the alternative to one or more of the above components, the vehicle detection and recognition system (101) may also contain a connected physical RFID reader (not shown), an electronically activated motion detector (not shown), an electronically activated proximity detector (not shown), a Bluetooth connection dongle (not shown), a WiFi connection dongle (not shown), and an infrared illuminator (not shown).

The vehicle detection and recognition system (101) may also include various software systems designed to recognize and extract information from the captured vehicle images, including a license plate recognition (LPR) system, an automatic number plate recognition (ANPR) system, a QR Code recognition system, a barcode recognition system, a vehicle color identification system, a vehicle profile identification system, a motion and proximity detection system, along with various software drivers designed to send text messages and images to the display device (100).

The vehicle detection and recognition system (101) communicates motion detection information, and detected changes in proximity status to computer (108). The vehicle detection and recognition system (101) can be configured to either transmit the requested image stream up to computer (108) for further processing as an HTTP stream, or allow the computer (108) to access the stored image files on the solid state storage device (162) remotely through a file transport protocol. The computer (108) can then further process the images to extract vehicle identification information, including the license plate number, QR Code, barcode, vehicle color and vehicle profile. Captured surveillance camera (102) images may also be processed to extract vehicle identification information.

In some embodiments multiple vehicle detection and recognitions systems (101) can be connected to one computer (108). Computer (108) can be configured so that it is not overwhelmed with multiple unchanging transmitted images, and can focus its activities on processing information from only those parking spaces (105) where there is a detectable physical change in status.

In particular embodiments, the camera (153) generates 1 Gig of data per hour, writing 640×480 pixel images, 5 times a second, to the solid state storage device (162). Thus if the storage capacity of the solid state storage device (162) card is 8 gigs, for example, then 8 hours of recording time is available on the memory card before existing images would be over-written by new images that are being saved. During periods of no activity, the image contents from the solid state storage device (162) can be serially moved and saved to a large capacity hard drive storage unit (146) on computer (108).

In particular embodiments, the vehicle detection and recognition system (101) post-processes incoming images by performing the following steps:

(a) Reduce the image size to 640×480 and then save the image to the solid state storage device (162).
(b) Edge enhance the image so as to reduce lighting artifacts.
(c) Load one or more pre-saved images from the solid state storage device (162) from different time periods, and edge enhance these images.
(d) Image compare the current enhanced image against each of the loaded enhanced images in a grid pattern (e.g. left to right, top to bottom).
(e) Quantify which grids have changed between the comparison images to determine if there is motion.

If motion is detected, then the grid motion information can be further quantified to identify direction of motion, and proximity of motion to the lower edge of the image. The system may quantify how many grid elements are different from the base reference image of an empty stall to determine if there is a vehicle (104) parked in the parking space (105).

For example, if there is motion detected across the width of the image in the downward direction (heading towards the bottom of the image), and the line at which the change is occurring is getting closer to the bottom of the image, then that may be interpreted to mean that a vehicle (104) is in the process of parking. If there is no detected motion, but the foreground of the image (near the bottom of the image frame) is radically different from a reference image taken when the parking stall was empty, then that may be interpreted to mean that there is a vehicle (104) parked in the parking space (105). If there is motion in the upwards direction to the bottom frame of the image, then that may be interpreted to mean that a vehicle (104) is leaving the parking space (105).

Figure 5B:
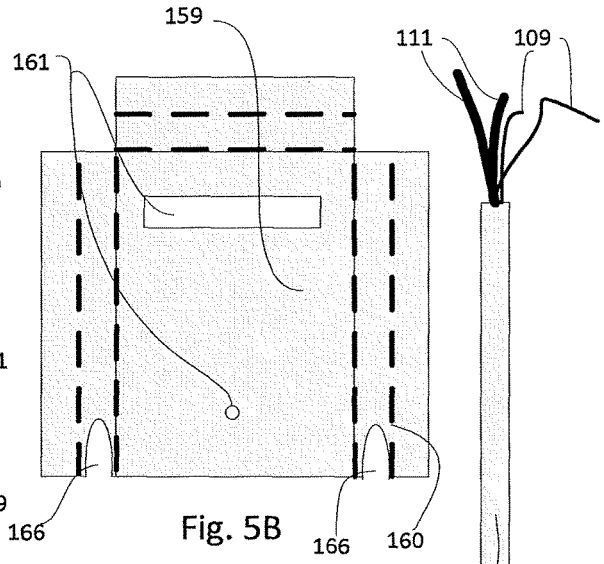

The parking space management unit (134) displayed in FIG. 5A is configured to mount directly onto a wall. Anchor bolts (157) attach the unit to the wall. A flat folded housing element (159), that may be fashioned out of a flat metal sheet, is shown in FIG. 5B. The housing element (159) is folded, then placed over top of the body of unit (134), and securely fastened (fasteners not shown) so as to create a water-tight protective covering. The housing element (159) is folded along the dotted lines (160) so as to fit around the edges of the unit (134). The housing element (159) is installed by placing the folded housing above the unit (134), and sliding down until secure, then fastening it with fasteners (not shown). The housing element (159) contains two cut holes (161) that are covered by a clear waterproofed window. One hole is for the display device (100) to be visible. The other hole is for the camera element (153) to be visible. Slots (166) are cut in the housing element to allow wires to exit from the sides.

Figure 5C:
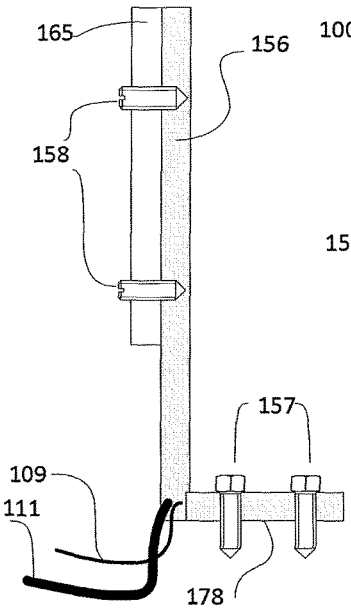

FIG. 5C is a partial cut-away of the unit (134) from the side, showing how the square steel tube frames (156) can be extended in length to create free standing supports. The base element (165) is secured to two elongated square steel tubes (156) using connector bolts (158). The square tubes (156) have an attached welded foot (178) that is secured to the floor surface of parking area (106) using anchor bolts (157). In an alternate embodiment, the welded feet (178) might be facing the other way, or can be attached to the steel tubes (156) in both directions.

Figure 5D:
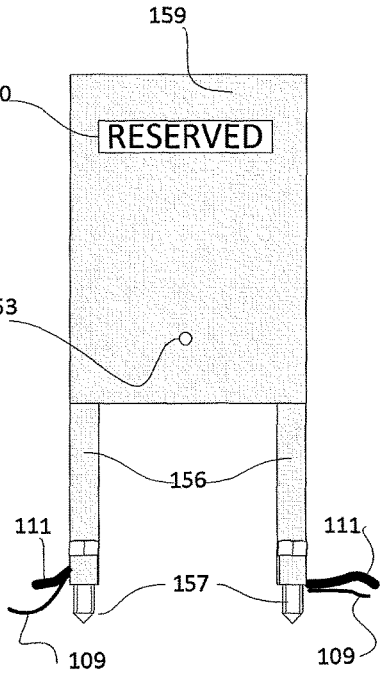

FIG. 5D shows a free standing unit (134), bolted to the floor surface of parking area (106). The wires or cables (111, 109) enter and leave the square tubes (156) at ground level.

Figure 5E:
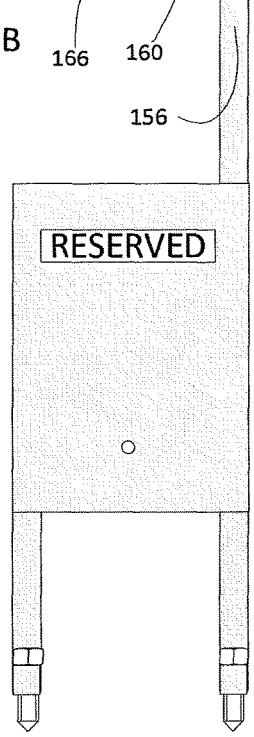

FIG. 5E shows a free standing unit (134) bolted to the floor surface of parking area (106), with one elongated square tube (156) extending to the ceiling. The wires or cables (111, 109) enter and leave the square tube (156) from the ceiling.

Free standing parking units (134) can be installed back-to-back in open parking space areas (106) (parking areas that do not terminate at a wall).

FIG. 6 shows a schematic of how the various components of the parking space management system (99) can be connected to the user agents (125,126,127,128,129,141), web-based servers (118), and cloud based servers (119).

The database collection (117) of the parking space management system (99) of FIG. 4 contains information necessary for the operation of the locally connected parking spaces (105). Such databases (117) can be accessed by the computer (108) they are stored on, by a remote computer over a network or by a remote computer over the Internet. In one embodiment, the computer database (117) is able to synchronize itself by connecting to and accessing the contents of a web based database (118) within a web-based control system (118A) shown in FIG. 6.

The parking space management system (99) allows for accessing a web-based database (118) stored in the web-based control system (118A). The web-based control system (118A) allows integrated control over multiple aggregated parking space management systems (99). The user interface to the web-based control system (118A) is either provided through a web page, or through a wirelessly connected mobile device application. The web-based database (118) may also be synchronized to a web-accessible cloud database (119) within a cloud-based control system (119A) used to manage one or more web-based control systems (118A).

The parking space management system (99) allows for accessing a database (119) stored in the cloud-based control system (119A). The cloud-based control system (119A) allows integrated control over multiple aggregated web-based databases (118). The user interface to the cloud-based control system (119A) is implemented through a cloud-based software interface that may include, but is not limited to, either a web page or mobile device application.

The web-based database (118) contains aggregated data for one or more computer based databases (117). The web-based database (118) can be accessed by a remote computer connected over the Internet. In one embodiment, the web-based database (118) is able to synchronize itself by connecting to the contents of a cloud based database (119). The cloud based database (119) contains aggregated data for one or more web-based databases (118). The cloud-based database (119) can be accessed by a remote computer connected over the Internet.

As shown in FIG. 6, web-based control system (118A) and cloud-based control system (119A) may interact with a registered user (152). Normally the vehicle owner and the registered user (152) are the same person, and billing issues are tied to that one person. In an alternate embodiment, the registered user (152) may be a different entity from the registered vehicle owner. In this case, the registered user (152) may make a reservation for one or more parking spaces (105), that accept one or more vehicles (104). The registered user (152) assumes the reservation costs, and/or the parking costs for those spaces (105). An example would be where a service provider (such as a banker) reserves in advance parking spaces (105) for her high value customers.

With reference to FIG. 6, computer (108) can send parking event notifications to authorized user agents (125, 126,127,128,129,141), or other connected communication systems through the notification module (139). The communication mechanisms used to send a message can include: instant text message, email message, recorded voice mail message, or other means of electronic notifications, including displaying the message on the dynamically updatable display device (100). Authorized user agents include the local parking lot attendant (125), a remote parking lot attendant (126), the vehicle operator (127), the parking space manager (128), the parking space owner (129), and the tow truck dispatch agent (141). Other possible user agents (which may be the same person or entity as the above-listed user agents or a separate person or agent) are the parking lot owner and parking space management system operator. Other connected communication systems may include an event monitoring system, email system, file storage system, or other automated messaging system, where the messages are stored for future retrieval and processing.

FIG. 7 shows an example embodiment of a computer-implemented user interface for users to log into a reservation system and book one or more parking reservations. Users can manage multiple parking reservations through this interface. Reservations can be made for an individual, or a group of individuals. Reservations can be made for a 24 hour period, for the day, for the morning only, for the afternoon only, for the evening, for an event, or by the hour. Reservation details are stored in the parking space availability database (135)

While the reservation is active, the vehicle operator (127) can enter and exit the parking space (105) without the reservation ending (referred to as 'in-out privileges'). If a vehicle operator (127) wants the reservation to end when they exit the space (105), then they would book a reservation with a shorter duration.

In one embodiment reserved parking availability is dynamically adjusted based on user demand, and may be optimally priced in a way to maximize revenue for the parking space owner (129). For example, to encourage full day parking reservations, pricing per-hour may be lower than if a user wants to reserve for just the afternoon. But, as the reservation time slot nears, and the parking space (105) still hasn't been reserved, the price per hour for the afternoon slot may be less than the quoted price per hour for the day slot. The difference in hourly pricing for each of the slots may be indicated in the user interface through color coding each of the individual squares. Light background colors indicate reduced rates, while darker background colors indicate premium rates (not shown). The user would have to click on each square, or hover over the square to get the actual quoted price.

FIG. 8 shows an example embodiment of the computer-implemented user interface for editing the stored vehicle information in the stored vehicle identification database (136). Some pieces of data maintained in the vehicle identification database (136) include the vehicle identification information, the operator contact information, the vehicle billing information, and the vehicle group memberships. A single vehicle (104) can belong to one or more groups. If the vehicle (104) does not belong to a reservation group, then by definition it is not allowed to park in the reserved space (105). The default group name for a vehicle is its identification license plate number.

FIG. 9 shows an example embodiment of the computer-implemented user interface for reviewing the information in parking space events database (137). In particular embodiments, events are stored in a tabular format, where each column in the table can be individually set as the current sort order. Records are added to the parking space events database (137) by the vehicle detection and recognition system (101) and the reservation module (143). The contents of the parking space events database (137) are accessed by the notification module (139), and by the billing and payment module (138).

Figure 10:
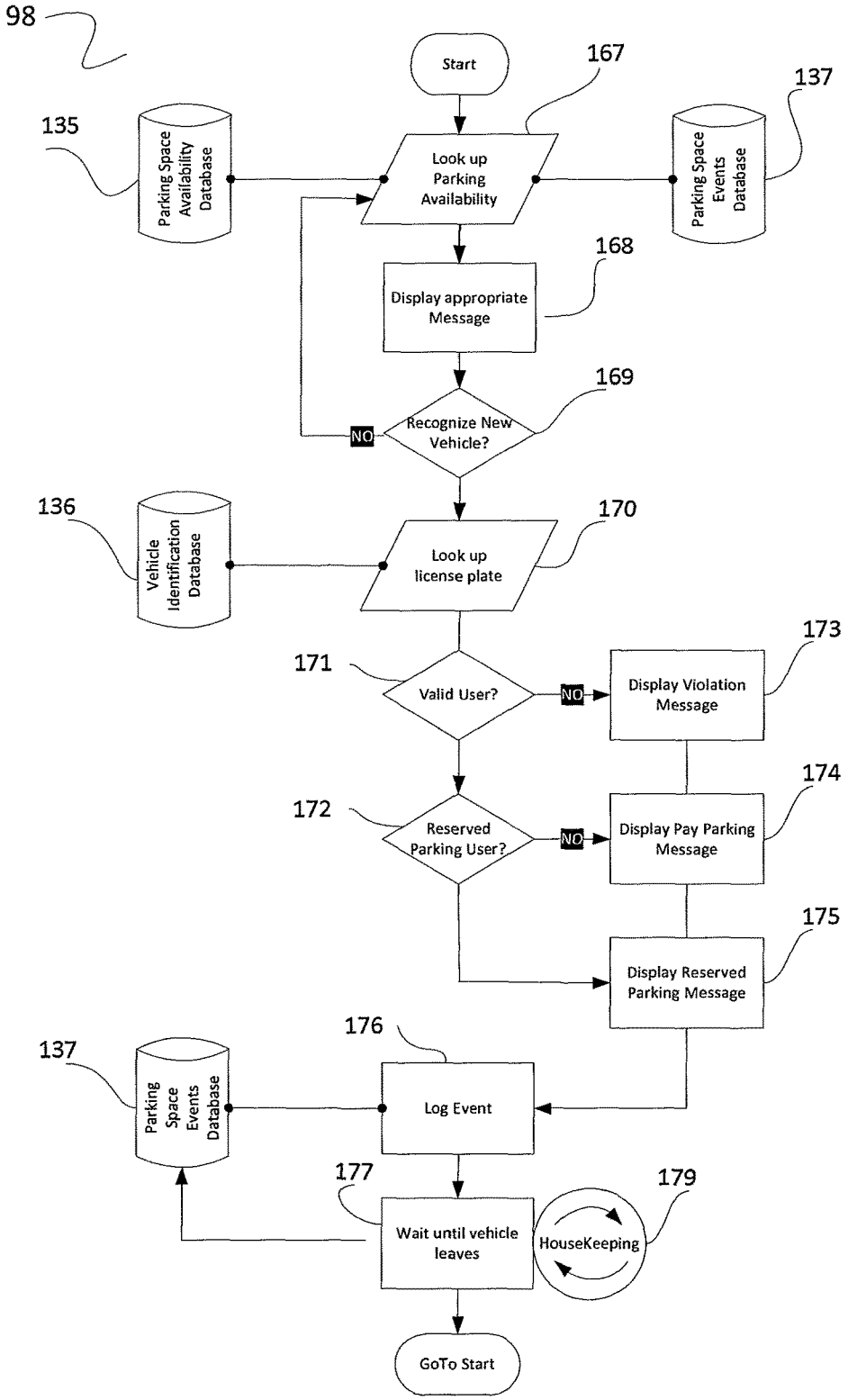
FIG. 10 is a flowchart of a method for automatic parking space management.

FIG. 10 shows an exemplary method (98) for managing a parking space (105). The steps of this method (98) may be implemented as software functions or modules contained in a program memory (145) accessible to processor (144) of computer (108) of system (99) (FIGS. 1 and 4). The processor (144) implements the steps by executing software instructions provided by the software functions. The steps of method (98) to manage the parking space are:

1) In process step (167) the reservation module (143) retrieves the currently active parking space rules from the parking space availability database (135) to determine what the active reservation is. Parking space rules are cross referenced against events in the parking space events database (137) to determine what the appropriate message to be displayed on the display device (100) is.
2) In process step (168), the reservation module (143) sends the returned message from process (167) to the display device software control module (132) to be displayed on the display device (100).
3) In process step (169), the reservation module (143) queries the vehicle detection and recognition system (101) to check if it recognizes a new vehicle (104) entering the parking space (105). If there is no new vehicle (104), then the process loops back to step (167) to re-check the parking space availability database (135). Otherwise, the method proceeds to step (170) and passes on a list of allowed reserved parking groups retrieved from the parking space availability database (135).
4) In process step (170) the reservation module (143) calls the license plate recognition module (116) to identify the license plate number of the vehicle (104), and then matches the returned data, such as license plate details, QR codes, Barcodes, Bluetooth signatures, WiFi signatures, vehicle color, make and/or model against the known license plates in the vehicle identification database (136). If a match is found, the process returns a list of groups that the vehicle (104) belongs to, along with detailed messages to be communicated to the vehicle operator (127) for each of the groups that the vehicle (104) belongs to.
5) In process step (171) the reservation module (143) determines whether the license plate number is associated with a valid user. If the license plate is not recognized, or the identified vehicle group list does not belong to a valid parking group from the parking group list, then the method proceeds to step (173), and displays a parking violation message on the display device (100). Otherwise, the method proceeds to process step (172).
6) In process step (172) the reservation module (143) determines if the list of groups that the identified vehicle (104) belongs to matches an existing reserved parking group. If there is a match, then the reservation module (143) proceeds to step (175) and tells the display device software control module (132) to display a customized reserved parking validated message on the display device (100). Otherwise, the reservation module (143) proceeds to step (174) and tells the display device software control module (132) to display a customized pay parking message on the display device (100).

7) In process step (176), after the appropriate messages have been displayed, the reservation module (143) logs the parking event in the parking space events database (137), and proceeds to step (177).

8) In process step (177), the reservation module (143) loops in a house-keeping mode (179) until the vehicle (104) exits the parking space (105). On detecting that the vehicle (104) has exited, the reservation module (143) displays an appropriate message on the display device (100) through the display device software control module (132). The reservation module (143) then logs an event to the parking space events database (137), and loops back to the start of the process flow chart—process step (167).

Figure 11:
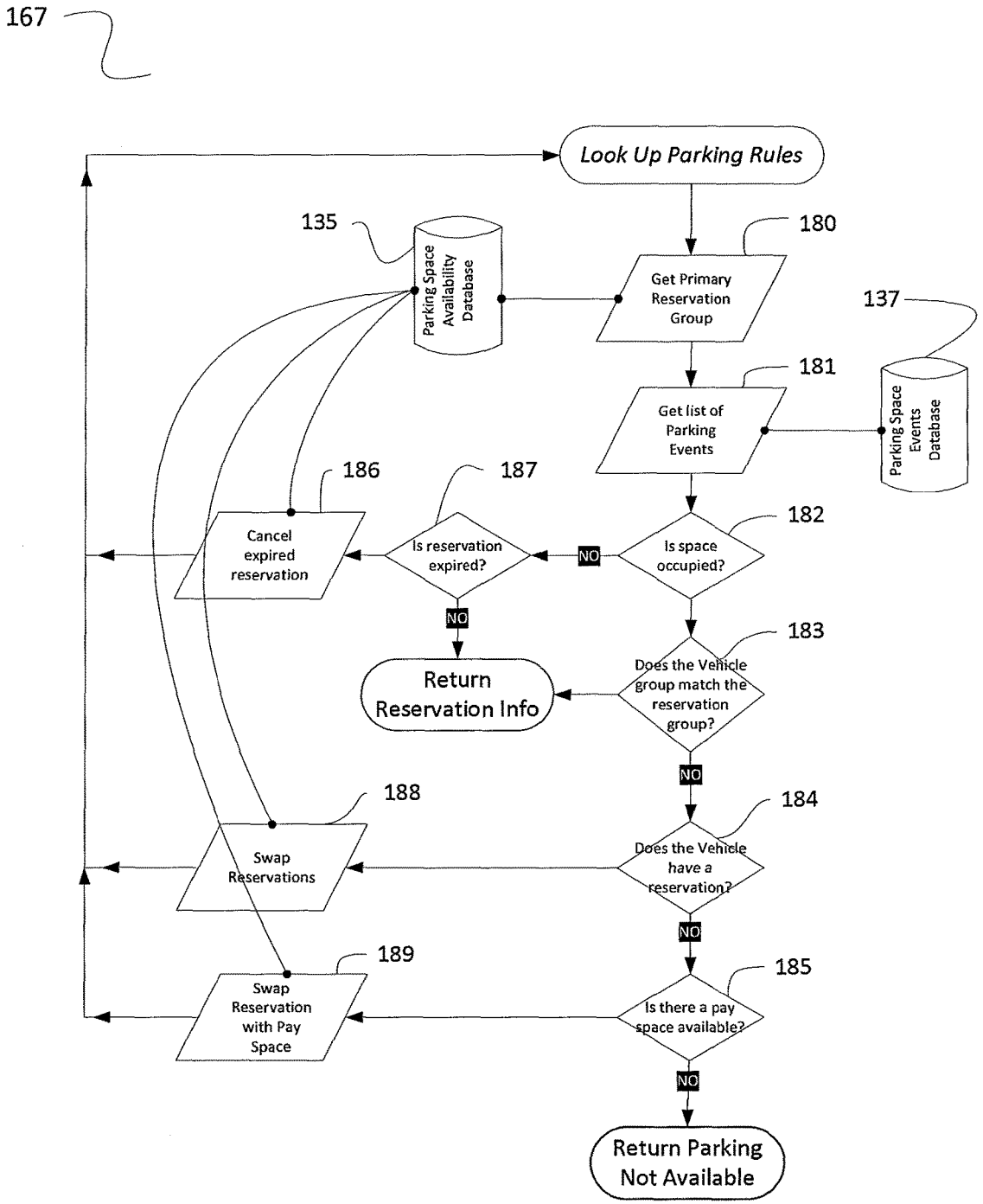
FIG. 11 is a flowchart of one exemplary method for automatically re-configuring the parking space management system based on customer usage.

FIG. 11 shows an exemplary method (167) for looking up parking availability, i.e. to determine what the current parking rule is for a parking space (105). Because the system is self-configuring, and adaptive, parking rules dynamically change between connected parking units (134).

FIG. 11 shows how three different events result in the connected systems re-configuring themselves. These events are: 1) a registered vehicle (104) with a valid reservation pulls into the wrong empty parking space (105). 2) a registered vehicle (104) without a valid reservation parks in a parking space (105) currently reserved for another vehicle (104). 3) A vehicle reservation expires, and the system needs to convert the parking space (105) to pay parking.

The steps of this method (167) may be implemented as software functions or modules contained in a program memory (145) accessible to processor (144) of computer (108) of system (99) (FIG. 1). The processor (144) implements the steps by executing software instructions provided by the software functions.

The steps of method (167) to determine the currently active parking rule are as follows:

1) In process step (180) the reservation module (143) retrieves the named group of the currently active reservation from the parking space availability database (135). By way of example, a returned named group might be the string "XYZ 123". Note: If there is no active reservation, then an empty string is returned, and as we see below, the parking space (105) will revert to pay parking.

2) In process step (181) the reservation module (143) retrieves the latest parking events for the parking space (105) from the parking space events database (137), including details on whether there is a vehicle (104) currently parked in the space (105), what the vehicle identification is, what active group it matches, and whether or not it has a reservation.

3) In process step (182), the reservation module (143) determines if the parking space (105) is currently empty, and if so, determines if the current named group reservation has expired (187). If the reservation has expired, then that reservation is cancelled (186) in the parking space availability database (135), and the process cycles back to the start of the method (167) to obtain the next in-priority reservation status. If the parking space (105) is empty, and the reservation has not expired, then the current reservation is returned, and the process exits. In the event there is no reservation (signified by an empty string), the 'available for pay parking' default reservation is returned, and the process exits.

4) In process step (183), the reservation module (143) determines if the currently parked vehicle (104) is a member of the named reservation group. If the vehicle group name and the reservation group name match, then current reservation is returned, and the process exits.

5) In process step (184), the reservation module (143) checks if the currently parked vehicle (104) has a reservation (indicated by what was returned from the parking space events database (137)). If the vehicle has a reservation, but is not in the correct parking space (105), that means it is parked in the wrong parking space (105). In this case, the parking space (105) that holds the original reservation needs to be swapped with the current reservation (188) in the parking space availability database (135) and the process cycles back to the start of the method (167) to obtain the next in priority reservation status. In this manner, if there are stacked priority reservations, they are all moved to different parking space locations until the correct reservation is returned that matches the currently parked vehicle (104).

6) In the event that the current vehicle (104) does not have a reservation, and is parked in someone else's reserved spot, the reservation module (143) attempts to find an available pay parking space (105) in the parking space availability database (135). If a pay parking space is found, then the pay parking status is swapped for the reserved parking reservation in the parking space availability database (135). The reservation module (143) then recognizes 'pay parking' for this parking space (105), and at some time in the future, when the switched pay parking space (105) checks its reserved parking rules, the reservation module (143) will recognize the recently switched reservation information for that switched spot. If an available pay parking space (105) is not available, then the current reservation is returned, and the parked vehicle (104) will be notified through the display device (100) to exit the parking space (105). In this manner, the diagram demonstrates how the parking space management system (99) is self-adjusting and adaptive.

Figure 12A:
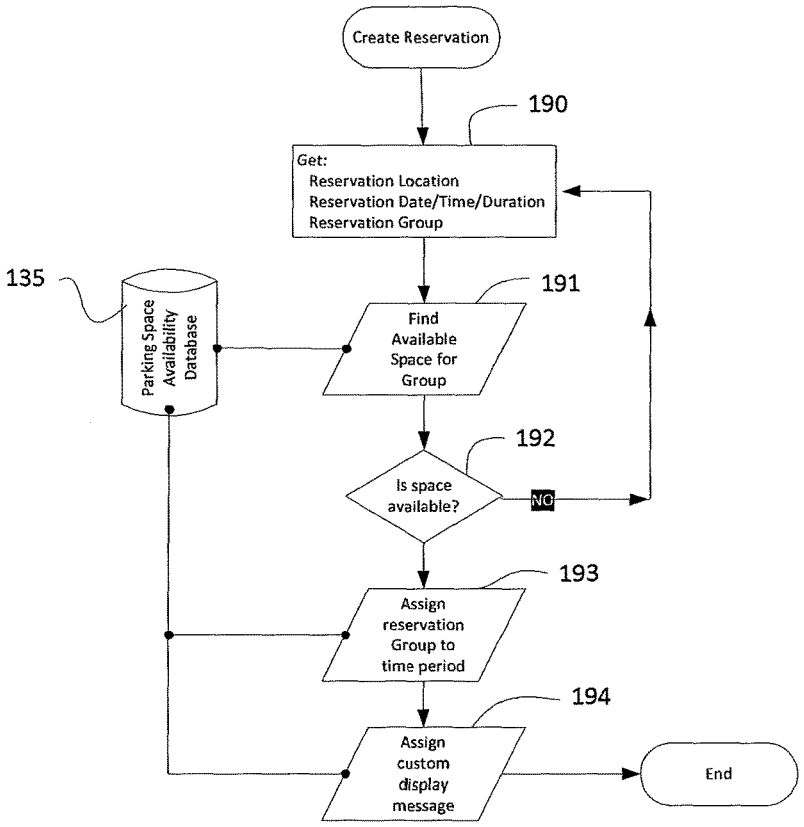
FIG. 12A is a flowchart of one exemplary method for determining what spaces and times are available for a group reservation.

FIG. 12A is a flowchart that shows an exemplary method for identifying what parking spaces (105) are available, and the process by which the reservation module (143) creates a reservation in the parking space availability database (135). Thus the process steps outlined in FIG. 12A show the process by which a reservation is booked. The process steps of FIG. 12A may be implemented as software functions or modules contained in a program memory (145) accessible to processor (144) of computer (108) of system (99) (FIGS. 1 and 4). The processor (144) implements the steps by executing software instructions provided by the following software functions.

Figure 12B:
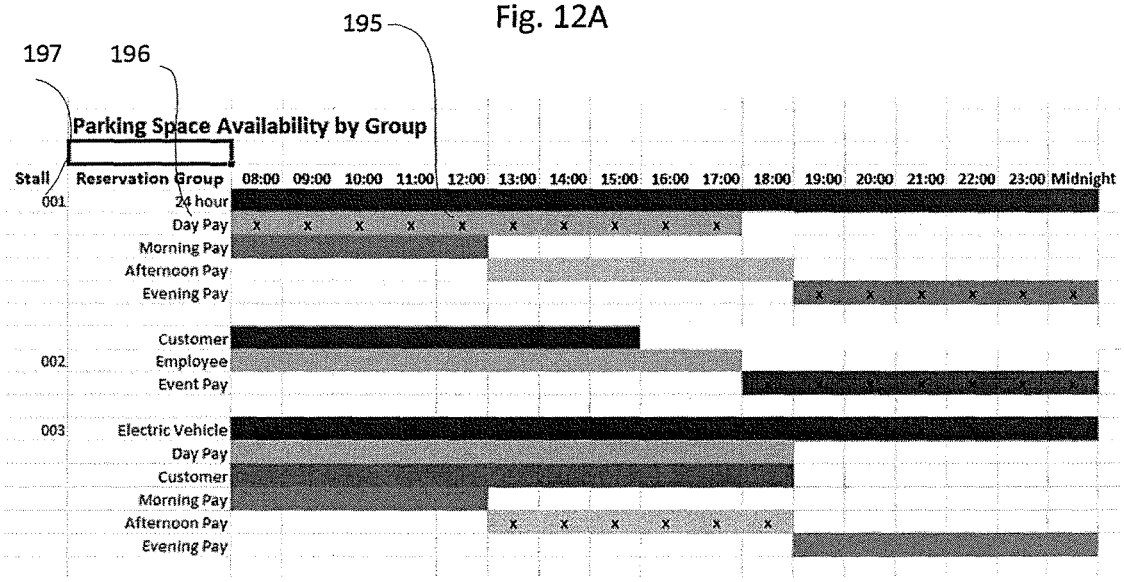
FIG. 12B is an exemplary web page interface for displaying parking space availability by group.

1) In process step (190) the reservation module (143) is passed the user requested reservation location, the requested reservation date and time, the requested duration (or length of stay), and the reservation group name. The group name is used to match availability in the parking space availability database (135) as shown in FIG. 12B and described below.

2) In process step (191) the reservation module (143) performs a database query using a selection set to determine if there are any parking spaces (105) available that match the collected parameters from step (190).

3) If there are no available reservation spots available in the parking rules database (192), then the reservation module (143) returns, and the calling application (possibly a web browser) may be notified to change one or more parameters, and search again.

4) In process step 193, if a parking space availability has been found, then the reservation module (143) marks the parking space (105) reserved for the specified time period in the parking space availability database (135), and in process step (194) the calling application is prompted to enter a unique display message used to hold the newly created reservation, which is stored in the parking space availability database (135). This entered display message is the display message (151) that will end up being displayed on the dynamically updatable display device (100) when the reservation becomes active.

FIG. 12B shows an example embodiment of the computer-implemented user interface (113) (FIG. 4) for updating the parking space availability database (135). The look and feel of the graphic display depends on what display device (100) the information is being displayed on. Through the user interface display, the parking space manager (128) (FIG. 6) can interactively create, view, and modify the vehicle usage parameters for the parking space(s) (105) under management. An alternate embodiment allows the manager to group multiple combined parking spaces (105) similar to how the user would manage a single parking space (105).

One feature of the example scheduling interface is that the parking space manager (128) can define group names, and then assign which group names are allowed to park in the parking space (105) during which times in the day, evening, night, week-days, weekend, and holidays. Particular embodiments provide a calendar interface, and the user can then fill in the grid with group named boxes.

One feature of the user interface is that identified group use of the parking space (105) can overlap—for example, during certain times of the day, the office group, and the customer group can both accept reservations for the same time period (on a first come, first served basis).

The same group names are assigned to vehicles in the vehicle identification database (136). This way, all vehicles in the group can be identified through a relational database lookup. By default, a group name with only one vehicle in it may be given a group name that matches the vehicle identity that it represents (that most likely being the license plate number).

Each parking space (105) has its own defined set of rules as to what groups can reserve a parking space (105) during what times of the day. FIG. 12B demonstrates reserved parking space availability for each of three connected parking spaces (105). Parking space 001 (197) is configured to allow five different groups (196) access to its reservation space. Parking space 002 supports three different groups, and parking space 003 supports five different groups. Note that the group designations in each parking space over-lap. A member of the 'Day Pay' parking group can book parking space 001, but so too can a member of the 'Morning Pay' group. Reservations are allocated on a first-come, first serve basis. The parking space manager (128) can adaptively manage the group availability settings to maximize parking lot usage. Any parking space (105) that does not have an active reservation becomes a pay for parking space (105).

In FIG. 12B, current reserved time blocks are indicated by 'x' values (195). In this manner, a system can request which parking spaces (105) are available for a specified group, and can get back the following selection set: [A: matches group designation AND B: is not currently reserved]. Each defined group has its own minimum number of hours accepted by the system. By way of example, if making a 24 hour reservation, the user must agree to pay for at least 14 hours. If making a day reservation, the user must agree to pay for at least 6 hours. Morning reservations require a minimum commitment of 5 hours. Evening reservations require a minimum commitment of 6 hours. Each group also has associated with it an hourly billing rate. Evening hourly billing rates are much less than morning hourly billing rates. If a parked vehicle (104) remains in the parking spot (105) after their reservation expires, they will continue to be charged at a specified hourly rate.

EXAMPLES

The following are non-limiting examples of how a parking space management system (99) in accordance with embodiments described herein may be used to manage parking spaces (105).

In one embodiment, a registered user (152) (FIG. 6) logs into a Parking Reservation web-site from an Internet connected computer, tablet, or mobile device, and reserves a parking space (105) for a specific period, such as for the day, morning, afternoon, evening, or for event parking. The user (152) already has an account set up, and billing is handled through the billing and payment module (138) as described above. The default customizable reservation display string is set to 'Reserved for Jane Doe'. Once the reservation has been made, a confirmation email is mailed to the user.

At the appointed time of the reservation, the next available empty parking space display device (100) changes to show the personalized name of the person who has reserved and paid in advance for the parking space (105). When that person drives into the parking lot (106), they may see multiple 'reserved' spaces, but only one of them will read: 'Reserved for Jane Doe'. When Jane parks her vehicle (104), the display device (100) changes to say 'Welcome Jane', indicating that the system (99) has recognized the vehicle (104), and that the vehicle (104) is authorized to park there. The display device (100) may then change to include a display clock indicating the number of minutes that the vehicle (104) has been parked and is being billed for.

If Jane decides to stay longer than the allotted reservation time, additional hours are billed to the registered vehicle owner (which may be the same or different from the vehicle operator (127)). When Jane leaves in her vehicle (104), the display device (100) changes to thank Jane for parking, and then changes to the next available reserved status message. Jane also receives an email receipt billed to her credit card, the number of minutes parked, along with a time-stamped picture of the vehicle (104) entering and leaving the parking space (105).

In an alternate embodiment, the parking space management system (99) can be used to generate additional parking revenue from an under-utilized monthly reserved parking space (105) in the following manner:

Instead of a static painted 'reserved' sign hanging in the parking space (105), there is a dynamically updatable LED display device (100) hung in its place, indicating the current status of the parking space (105). During normal business hours the display device might display 'parking reserved for John Smith'.

On evenings, weekends, and holidays, if the space (105) is available, the display device (100) might display: 'parking available to registered vehicles only'.

To register the vehicle (104) for the first time, the vehicle operator (127) calls a posted 1-800 number, or accesses a posted Internet based web-page, and provides the necessary information to register their vehicle (104) in the system (99), including contact information, vehicle identification information, and billing information.

Assuming that the vehicle operator (127) has previously registered their vehicle (104), the vehicle operator (127) can pull into the empty reserved parking space (105) and park. At this point, the vehicle detection and recognition system (101) identifies the vehicle's license plate number, and the computer system checks to determine if the vehicle (104) is registered. Once the vehicle identity has been confirmed, the display device (100) now changes to read: 'you are authorized to park here', followed by a second message: 'parking is $7.00 per hour', and finally: "parking is available for the next 13 hours". If the vehicle (104) is not recognized, then the display device (100) changes to read: 'unauthorized vehicle. Please register, or your vehicle will be towed'.

If the vehicle (104) is authorized and remains parked, this represents implied acceptance of the parking contract between the buyer and the seller. The vehicle operator (127) can now leave the vehicle (104), and carry out their activities. The display device (100) then changes to read 'reserved for Mr. Vehicle Owner', or some other personalized message.

If a parking patrol vehicle drives through the parking lot (106), and notices that the display device (100) shows the message: 'unauthorized vehicle', then a parking ticket is generated, a tow-truck is summoned, and the vehicle (104) is towed. Optionally, the system (99) can be configured to automatically generate a towing event email or text message, and a remote operator can respond by reviewing the web camera data feed, and then initiate a call to a tow-truck operator dispatch (141).

If the allotted parking time is about to expire, and the parking space use is changing, the owner of the currently parked vehicle (104) can be notified by text message, email, or voice mail, that the parking contract is ending, and the vehicle operator (127) needs to come back and remove their vehicle (104) from the parking space (105).

When the operator (127) exits the parking space (105), a billing event is triggered, and the vehicle owner's credit card is charged for the parking time used. The display device (100) then re-sets to indicate the updated parking space (105) is again available, and the display device (100) now reads 'reserved for registered users'.

If at any point the vehicle (104) is vandalized, or damaged, or stolen, the stored surveillance images (142) derived from the optional video surveillance system cameras (102) can be accessed to review what happened.

In particular embodiments, all communication sent from the parking space management system (99) to the vehicle operator (127) at time of parking can be provided through the interactive display device (100). At no point during the interaction between the vehicle operator (127) and the parking space management system (99) does the vehicle operator (127) need to do anything special to obtain information regarding the availability or status of the parking space (105), other than read the display device (100), and make a decision on whether it is permissible to park based on what message (151) is being displayed.

In an alternate embodiment, should the parked vehicle (104) not be recognized, the display device (100) could instruct the vehicle operator (127) to purchase a ticket from the local parking lot electronic ticket dispenser. As part of that process, the user either enters a stall number, or a license plate number into the ticket dispenser interface, and the electronic dispenser electronically communicates that information to the parking space management system (99) to confirm that a parking ticket has been purchased. On receipt of confirmation, the parking space display device (100) can change its display message (151) to say 'Validated'. If the vehicle parking time expires, the display message (151) can change to say 'Time Expired'.

In an alternate embodiment, the parking management system (99) electronically communicates parking status information for each of its parking spaces (105) under management, to the existing electronic ticket system. Enforcement personnel that use the electronic ticket system information to identify parking violators do not have to switch to using a different enforcement system. In this fashion, the existing electronic ticketing system, and the new parking space management system (99) can co-exist in the same parking lot.

In an alternate embodiment, a company reserves a special parking space (105) for the top sales person of the month. The display device reads: "Reserved for the top sales person of the month". If another employee tries to park in that space (105), other than the top salesperson, a personalized message (151) gets sent to the display device (100) matched to the recognized vehicle owner identity: "John, you were the second highest sales person on the month. You need to try harder and get out of Tim's spot".

In an alternate embodiment, in the event that a vehicle (104) is not recognized, a personalized message (151) can be displayed: "Vehicle with plate number XYZ 123—You are not authorized to park here—You must remove your vehicle, or a tow truck will be dispatched". Then, the display device (100) shows a tow-truck image, pulling a vehicle, along with a count-down clock indicating the amount of time before the truck arrives.

In an alternate embodiment, reserved users can arrive late in the morning, knowing that their reserved parking space (105) will be sitting there empty. Then, if they need to run an errand for an hour later in the day, the space (105) will recognize that the vehicle (104) has left, and reverts back to the customized reserved message until the vehicle (104) returns, or until the allotted reservation time has expired.

In an alternate embodiment, users register and pay in advance for event parking. If a vehicle (104) were to arrive early before the appointed time, and park in an available parking space (105), the display device (100) would indicate that the vehicle (104) is recognized as parking for the event, and so therefore does not have to move, but that an extra hourly rate is going to be charged. At the appointed time when the event parking reservations kick in, the display devices (100) are programmed to display a customized message (151) related to the event. For example, the device (100) says "Registered parking for Jane Doe", followed by an animated graphic: "Go Canucks Go!"

In an alternate embodiment, the disclosed parking space management system (99) can be used to manage parking spaces (105) reserved for customers in the following manner:

A restaurant owner has 20 parking spaces (105) reserved for customers in a parking garage. During times of the day when parking is limited, other vehicles (104) park in the reserved for customer spaces (105), and restaurant customers cannot find parking spaces (105) to park in.

Since it is too expensive to hire a full time parking lot attendant to police the use of 20 parking spaces (105), the restaurant owner decides to implement the disclosed parking space management system (99), and replaces the painted 'reserved for customers' signs with dynamically updatable LED display devices (100), along with a vehicle detection and recognition system (101), such as a license plate reader (LPR) system, in each of the parking spaces (105). The installed equipment is then connected to one or more computers stored in the restaurant office through a series of network cables. The computers are used to recognize the license plates, and to access the system database.

When a vehicle (104) pulls into the reserved parking space (105), the LPR system identifies the license plate, and uses that information to identify the vehicle (104). If the vehicle (104) has already been registered, and has an existing reservation, then the display device (100) changes to display 'welcome Mrs. Customer'. If the vehicle (104) is not recognized, or has not been registered, then the display device (100) changes to display 'You have 15 minutes to register at the restaurant, or your car will be towed'. If the vehicle (104) is recognized, and has been identified as a past violator, (and is not a customer), then the display device (100) changes to read 'please do not park here or your car will be towed'.

When a vehicle (104) parks in the reserved parking space (105), a message is automatically generated, and sent to the front reception at the restaurant. If that vehicle (104) is not validated within 15 minutes of parking by the restaurant hostess, then a tow-truck dispatch (141) is called.

In an alternate embodiment, the rental rate charged for parking can be set in the following manner:

During the day, the parking space (105) is reserved for business usage. Only registered vehicles (104) from the business may park in the parking space (105).

During the evening, weekends, and holiday, the parking space (105) can be rented out to registered evening parking vehicles (104). The amount charged for parking is dependent on what pre-defined group the parked registered vehicle (104) belongs to. If a parked vehicle (104) belongs to more than one group, then the rate for that vehicle (104) is set to the lowest of the rates.

During special events, the parking space (105) is rented out to registered event parking vehicles (104). The rental price is set to event parking rates, regardless as to what other group the parked vehicle (104) belongs to.

At any point in time, the parking space owner (129) can access the computer-implemented user interface (113) for the parking space (105), and update the usage parameters to modify the parking usage rules and charge out rental rates.

In particular embodiments, the usage parameters may be automatically updated in response to the parking requirements at any given time. For example, if there is required to be a minimum of one free handicapped parking space (105) in a parking lot, then the parking usage rules may reserve one space (105) for such purpose. If that reserved space (105) is then occupied by a vehicle (104) with handicapped status, then the parking usage rules may allocate a further parking space (105) for handicapped parking.

In an alternate embodiment, an LCD monitor or panel is substituted for the LED display panel in the dynamically updatable display device (100). The LCD monitor can display full motion 24 bit color video. It can be customized to play a video or scene when the reserved owner's vehicle (104) is parked, such as a display of fireworks and/or a mariachi band celebrating the owners' arrival. If an unauthorized vehicle (104) is detected in the parking space (105), the LCD monitor can be customized to play another video or scene, such as a nuclear bomb going off, and display a written warning indicating the consequences if the vehicle (104) is not moved immediately. Otherwise, the LCD monitor can be operated to display paid for advertisements visible to anyone who walks or drives by the parking space (105). In other embodiments, other types of displays, such as OLED, plasma, ELD and the like, may be operated to display such videos, scenes and/or advertisements.

One embodiment of the parking space management system (99) may be installed and used for guest parking spaces (105) for a downtown residential apartment tower. Guests must be registered by an apartment owner with the system (99) to park in the guest parking spaces (105), or otherwise they will be towed. Guests are only allowed to park for a certain number of hours before parking security is alerted. In the event of a problem with guest parking, it is immediately apparent from the stored event records which guest vehicles (104) are associated with which apartment owners. To help defray the costs of installing the parking management equipment, individual apartment owners may be charged a certain cost per day for any used guest parking. For an additional charge, guest parking spaces (105) can be reserved by apartment owners in advance of their guests arriving.

If the guest parking area (106) is too dark to properly identify the license plate, a camera (102) can switch to using infrared light to illuminate and read the license plate. This way, there are no flashing lights to distract the vehicle operator (127) while he is parking.

In an alternate embodiment, the parking space management system (99) can be configured to work within a parking area (106) configured as a gated parking lot as follows: Users log into a website, and reserve a parking space (105) for an agreed upon reservation fee. The fee paid guarantees a certain number of available reserved hours. The reserved sign in the gated parking lot confirms that there is a parking space (105) available during the reservation period. The user locates his reserved space (105) and parks. Payment for parking can be arranged pursuant to existing processes, and is not tied to the reservation. If reservation users do not show up in time to claim their reservation, then their advance reservation fee is forfeited.

In an alternate embodiment, the parking space management system (99) can be configured to work on a pay-for-parking basis only as follows: Users drive into the parking area (106), and park. If the vehicle (104) is recognized, billing is initiated. If the vehicle (104) is not recognized, then the vehicle operator (127) is told to move the vehicle (104) (e.g. this can be communicated via the dynamically updatable display device (100)). When the vehicle operator (127) gets back into his vehicle (104) and exits the parking space (105), billing stops.

In one embodiment, web-based reservations are created on the web-based control system (118A) functioning as a web server, but are not acted upon until the local computer (108) queries the web-based control system (118A) for local parking usage information specific to that parking space (105). In a similar manner, parking event details (changes to parking status) are uploaded from the local parking space computer (108), up to the web-based database (118). In this manner, the web-based database (118) serves as the consolidated storage location for all of the parking spaces (105) under its control. Scheduling and user information bubbles down into the individual local parking space computers (108), and parking event information bubbles back up. Email notification and billing activities can then be carried out by the web-based system rather than by the local parking space computer (108).

In the event of a system-wide configuration change, all locally connected computers (108) query the local web-based database (118) for the new configuration instructions. If the Internet connection happens to go down, the local computers (108) can still operate with the 'last available information' that was received. When Internet connectivity returns, the systems re-synchronize. If an individual parking system (99) happens to go down, then the web system can note the problem and re-schedule parking reservations to use the remaining operational parking spaces (105).

As an example of how the system (99) could work, consider the following: A user named Bob makes a reservation for a four hour afternoon parking space. The web-based database (118) is updated to store the reservation, and internal logic is executed to make sure at least one pay parking space (105) is available for the afternoon reservation commitment. As the time of reservation draws near, the web-based control system (118A) checks to identify which parking spaces (105) are reporting availability, and changes the status of one of these parking spaces (105) to read: 'Reserved for Bob'. The parking space details are downloaded by the local parking system computer (108), and the dynamically updatable display device (100) displays 'Reserved for Bob'. Additional data downloaded by the other available pay parking systems includes a list of all possible license plates that have a currently active reservation. If Bob arrives, and happens to pull into an available pay-for-parking space (105), the system still recognizes his vehicle (104), and an appropriate acceptance message (151) is displayed on display device (100) (such as "Welcome Bob. Your reservation has been activated"). A parking status update event is sent to the web-based database (118). The database then re-configures the internal settings, and the previously allocated reserved parking space (105) for Bob is released back to being available for pay parking.

As parking spaces (105) fill up with parked vehicles (104), the system (99) always tries to keep a parking space (105) empty if there are future reservations during the day that still have to be fulfilled. One way of doing this is to increase the hourly parking rate for the last remaining spaces (105). In this fashion, the system (99) is self-correcting, and adaptive to the possibility that no new spaces (105) will be available for the next booked reservation.

When parking space information is collected and retained by the web-based control system (118A) functioning as web server(s), parking space managers and/or owners (128, 129), or user agents such as parking lot operators, can access and review the collected data using various reporting tools. The data analysis allows the managers and owners (128,129) to identify peak usage periods, periods when there were not enough reserved spaces (105) available, periods when there were not enough pay parking spaces (105) available, and billing and usage history. Parking usage statistics can be tied to on-going promotions, past historical data, and information from other managed parking areas (106). A benefit for collecting all this data is to help parking managers and owners (128, 129) or other user agents maximize the revenue potential of their parking areas (106).

In an alternate embodiment, user information is stored in a cloud service database (119), and can be accessed by one or more web-based databases (118). This way, users only have to enter their information once into the system (99). A copy of the user information database (136) may be stored in the local web-based database systems, and a subset of the user database may be stored in each of the parking space management systems (99). If a vehicle (104) parks that is not recognized by the parking space management system (99), it queries the web-based database (118) for user details. If the web-based database (118) does not recognize the vehicle (104), it queries the cloud service database (119) for details.

In an alternate embodiment, credit and debit card information is stored encrypted in a cloud service database (119), and this information is purposefully not duplicated into the web-based server user database (118), or the local computer user database (136). Although billing details are generated by the local computers (108), the actual billing is done by the secure cloud based service (119A). This way, credit card information is kept securely in one place, without any other computers or individuals having access to the data, other than authorized company personnel. Billing can be done either under the name of the parking area (106), or under the name of the branded parking space management system (99).

In one embodiment, parking availability information can bubble up from the individual web-based server databases (118) up into the cloud servers (119), to provide an up-to-the-minute picture of what the parking lot usage statistics are within an entire city, and how many parking spaces (105) are currently available for reserved and pay parking, and how many reserved spaces (105) are booked into the future. Using this information, a single web page could be used to geographically display all available parking in a city, along with advertised hourly parking rates.

With dynamic access to usage statistics, individual lot owners can manage their sites in a way similar to how airlines manage their flights. Reserved parking prices can be offered at reduced rates to retain high usage customers, and to cover the parking garage costs. Last minute reservations, and additional pay parking is made available at a higher rate during peak demand times and at a lower rate during low demand times. Group rates, seasonal rates, weekend rates, event rates, and special promotions can then be offered to incrementally optimize revenue, based on the ability to measure what changes in behaviour were affected by which promotion.

In one embodiment, images of the parking space (105) are stored on the local computer (108). During periods where there is detectable movement, the storage frame rate might exceed thirty frames a second. During times where there is no detectable movement, the storage frame rate might be closer to one frame per second. The captured images are processed by the motion detection logic, and the license plate detection logic. If a license plate is detected in the frame, then additional logic is used by the local computer (108) to match the identified license plate to the vehicle owner information. If there are active reservations in place, and the license plate has five out of six characters the same as a reserved license plate descriptor, then the system (99) may make a statistically correct decision that this is one of the reserved vehicles (104), and accept the reservation.

If a license plate is detected, but not recognized by the system (99), there are a number of additional steps that can be taken. For example, the image can be run through various digital filters in an attempt to better identify the license plate characters. The various returned plate numbers can then be checked against the currently downloaded database looking for a match. If the license plate is still not recognized, then additional systems can be brought into use. The first of these systems is to send one or more images up to the web server for additional processing by a more powerful license plate detection system. That system might be installed on the web-based control system 118A functioning as a web server, or may be a separate network connected computer allocated for just this purpose. If the license plate detection server also cannot identify the vehicle (104), then a separate alarm might be triggered. A human operator can be asked to attempt the plate recognition by reviewing the images. In the event that even the human cannot match the license plate, the situation can be monitored to determine if a tow-truck needs to be called to remove the vehicle (104).

Images of the license plate may be stored on a local computer (108) in the event that they need to be later reviewed by a person or a license plate detection system to verify accuracy of a license plate number determined by the license plate recognition module (116) or to identify a license plate that the license plate recognition module (116) was unable to identify. As images are stored on the local computer (108), and the person reviewing the data is remotely connected through an Internet connected device, an interface may be provided where the user on the remote computer can connect directly to the local stored images, and use a standard Internet browser to view images or videos of stored image content. One way this can be done is for the local computer (108) to upload a single picture link to the web-based computer once every five minutes that a user can access and click on. By limiting bandwidth of uploaded images to a very small number, the network and web-based control system (118A) acting as a web server does not get overwhelmed with data. In this way, the user can review a small number of representational images on the web server to determine an approximate starting point, and then can view detailed images in succession direct from the storage location on the local computer, without unduly affecting Internet traffic through the web server.

The image storage and retrieval process described above can be used to support one or more additional security cameras (102) installed in the parking lot area (106). Image locator tags are uploaded to the web site from the security cameras (102). Users can review the time line to determine points of interest, and then click on the locator tag to connect directly to the locally stored image data. In this way, activities including vehicle theft, vehicle vandalism, and vehicle damage can be reviewed, and forwarded onto the proper authorities. Provided that there is sufficient Internet bandwidth, the users may be the original vehicle owners, and the process by which users view their parked vehicle (104) may possibly include the ability to monitor their vehicle in real-time.

In another embodiment, images collected by each of the vehicle detection and recognition systems (101) are stored on the local computer (108). The local computer (108) then sends a representative image along with an Internet link to the new set of images up to web-based control system (118A) functioning as a web server every specified time interval, that gets collected by the system (118A) and displayed in a web page. A user can log into the web page on the system (118A) to review the current status of the collected images. In this manner, a web connected user can view each of the managed parking spaces (105) from a single web interface.

The web page interface consists of a series of updated tiled picture elements, one picture element for each parking space (105). Each parking space image in the set of displayed elements is updated every specified time interval. The images change dynamically whenever the parking space (105) in question uploads a new image link, but because of the limited number of data uploads, the Internet bandwidth requirements are limited. With this capability in place the user can see everything that is going on in the parking garage in small timed increments.

If the web user wants to drill down into a particular parking space (105), they can click on one of the images, and a second web page is presented, this time with a timeline of collected images representing the past uploaded set, displayed according to a user controllable time scale. Using the time scale interface, the user can zoom down to see images for each minute, and zoom up to see images for each hour. If the user clicks on one of those images, then there is a direct connection made between the user on the remote Internet connected computer, and the local machine, and the local machine then sends parking space images in a video format over the Internet for the user to review. In this manner, a remote attendant (126) can manage one or more parking areas (106) from a single location.

With the ability to review parking lot activities from multiple camera angles, if there has been an accident, or a vehicle theft, or vehicle damage, or some form of parking dispute, the attendant (125) can log into the web-based server to review the data, and forward any video links that they find relevant to the vehicle owner, police, or insurance company.

In an alternate embodiment, the system (99) can be configured to work as a simple customer parking validation device. Vehicles (104) park in a space (105) that says "Customer parking only, 30 minute maximum". There is no need for the customer to register with the system (99), or be recognized by the system (99). When the customer parks, the display device (100) changes to say "please validate parking in the store". When the customer walks into the store, they see a tiled image of their vehicle (104) displayed on a LCD touch panel (or tablet) by the main entrance. The images are loaded from a web-based server, such as web-based control system (118A) that in turn is updated by the local parking computer (108), that in turn gets its data from the individual vehicle detection and recognition systems (101) in each of the monitored parking spaces (105).

There may be multiple display panels in the store, all loading data from the same web server. A display panel could be located at each store entrance, and one by each check-out counter. If the customer clicks on the image of their vehicle, that confirms they are a customer, and parking is validated. Once parking has been validated, the image could then display a count-down clock of amount of time left for parking (starting from the moment that the user parked). An alternate embodiment would be for the vehicle image to disappear when the customer clicks, and only those vehicles that have not yet been confirmed as valid customers are displayed.

In the parking space (105), once the customer validates her vehicle (104), the display device (100) changes to display 'validated'. At the end of the allocated time period, the display device (100) changes to read "allowed parking exceeded by 'x' minutes". The parking timer increments in timed intervals until the over-time period has exceed the maximum amount of allocated parking time. At that point, the display device (100) starts blinking, and flashes 'parking violation'. At this point, a tow-truck event is generated, and someone monitoring the system (99) calls a tow-truck dispatch (141).

The system (99) stores the license plates of those vehicles (104) that are known violators (added to the 'Violator' group). The next time that same vehicle (104) parks, the sign changes to read "30 minute time parking period strictly enforced", and when the customer clicks on their vehicle image, a display message comes up and reminds the customer that the 30 minute parking limit is strictly enforced, to which they must click an 'OK' button. If the vehicle (104) is a repeat violator, and the vehicle operator (127) does not come into the store and click on their vehicle image, then within 15 minutes, the parking space display device (100) starts blinking, flashing 'parking violation', and a tow-truck is called.

If the vehicle (104) has repeatedly violated the parking conditions, (added to the 'Repeat-Violator' group), but has never been validated, then the minute the vehicle (104) parks, someone can run out and talk with the vehicle owner—and try and resolve the parking issue, or have the vehicle towed.

A display sign out front of the store provides a counter indicating the number of available customer parking spots (105) in back for those people who can't find available street parking. Users can also log into the associated store web site to identify if customer parking spaces (105) are available in back. Reservations for short parking events are not supported, and parking is provided on a first-come, first served basis.

In the evening and holidays when the store is closed, the parking space system (99) can switch back to standard pay/reserved parking behaviour, or, the display signs can simply be turned off.

In various embodiments described above, the dynamically updatable display device (100) in the parking space (105) displays what the current usage rule is, and what the status of the currently parked vehicle (104) is. If the parked vehicle (104) is in violation of the usage rule, then the parking space management system (99) can be set up to notify the parking space manager (128), the parking space owner (129), or other user agents such as the lot owner, the parking space management system operator, the vehicle owner (if registered), and a tow truck dispatch (141).

As explained above, a computer controlled, highly visible, dynamically updateable display device (100), is used by the system (99) to direct parking activities. No user interaction or user equipment is required on the part of the vehicle operator (127) once the vehicle operator (127) has been registered with the system (99). The feed-back communication loop is provided through the display device (100). Users can drive into a parking area (106), and immediately see what text is being displayed on one or more display devices (100) from a reasonable driving distance. This way, users can identify which of the available parking spaces (105) is reserved for them, and in the event that they do not have an active reservation, which parking spaces (105) are available for demand parking. Text displayed on the dynamically updatable display device (100) is clearly visible from up to 10 meters (30 feet) away or more inside a lighted garage, an unlit parking space (100) in the evening, or in direct sunlight. The text scrolls vertically or horizontally to fit the display area. The display device (100) may also support the display of graphics and animated graphics.

An Internet-connected user interface accessible by a registered user (152) (FIG. 6), may allow the user to manually reserve a parking space (105). Once a parking space (105) is reserved, that person (and their vehicle) is guaranteed a parking space (105) during the reservation period.

In particular embodiments the parking space management system (99) can switch between managing reserved parking, and managing regular pay parking. For example, if there is no current active reservation, the parking space (105) becomes available for pay parking. If the current reserved parked vehicle (104) extends its stay, the system (99) reverts back to pay parking. To use the pay parking space (105), the vehicle operator (127) must still be registered with the present system (99), but does not need to have a reservation in place in order to park. If the vehicle (104) is recognized, the display device (100) indicates the vehicle has (104) been validated, and billing for parking is done automatically through the registered payment method. If the vehicle (104) is not recognized, then the display device (100) indicates that the vehicle (104) has not been validated, and needs to leave the parking space (105).

The benefit of the dual parking space management system (99) is that parking space usage (and therefore parking lot revenue) can be optimized. If the parking space (105) is not currently being occupied by a reservation, then the space (105) can be rented out for a per-hour charge. In a maximal revenue configured embodiment, the system (99) always leaves at least one space (105) available for pay parking. And, as the other spaces (105) become occupied, the price per hour to park in the last available remaining pay parking space (105) increases. That way, if there happens to be a conflict with one vehicle (104) not leaving its parking space (105) on time in order to clear out a reservation parking space (105), the system (99) can re-allocate the last demand parking space (105) for reserved parking use. If for whatever reason the last pay parking space (105) is not available, and a reservation cannot be filled, an event is generated, and a parking space manager (128) may have to intervene to resolve the issue.

In a similar manner, if a user shows up early for a reserved parking space (105), and cannot find her name displayed on any of the display devices (100), they can park in any of the available pay parking spaces (105), and the system (99) automatically adjusts itself so as to make sure the reservation is now tied to this current parking space (105).

The dual parking space management system (99) can be deployed in a parking area (106) in small numbers at first, and as the demand for reserved parking spaces (105) increases, (and more people register their vehicles (104) to use the system (99)) the parking space manager (128) and/or lot owner can invest in converting additional unmodified spaces into new managed parking spaces (105).

With the ability to vary the posted hourly rate for parked vehicles (104), the system (99) can dynamically balance the needs of the reserved parkers, the needs of the pay parkers, the number of parking systems (99) installed, and the needs of the parking space manager (128), parking space owner (129) and/or lot owner lot owner to maximize revenue. In this fashion, as usage adoption rates of the system (99) increase, and the average revenue per parking space (105) increases, so too can the number of installed systems (99) be increased, with supply and demand issues being resolved through dynamic adjustments to the cost per hour of each of the available installed systems (99).

The table below illustrates an example of how a parking space (105) can be dynamically repurposed and managed for different types of parking during different hours of the day and week. The dynamically updatable display device (100) for the parking space (105) can be updated as indicated in the table to communicate the status of the parking space (105) to users (152). The system (99) allows parking space revenues to be optimized for peak demand and low occupancy periods.

| Time | Message displayed on display device | Explanation |
|---|---|---|
| Fri 5 am: | 5 am: "Monthly Parking Reserved Mr. X" | Mr. X leaves Friday work, the space now available. |
| Fri 5 pm: | "Hourly Parking $4 per Half Hour" | Friday evening shoppers pricing premium paid. |
| Fri 9 pm: | "Valet Parking Roxies Bar" | Every Sat and Sunday to 5 am as per contract. |
| Sat 6 am: | "Hourly Rate $2 Secure Parking" | Attracting shoppers at below city meter rates. |
| Sat 7 pm: | "Reserved Parking Mr. Ho" | At $18 for a concert event as 5 hours of parking. |
| Sun 5 am: | "Reserved Visitor Parking $6" | Available to the many apartments near the lot. |

-continued

| Time | Message displayed on display device | Explanation |
|---|---|---|
| Mon 5 am: | "Monthly Parking Reserved Mr. X" | Returns to original monthly parking status. |
| Tues 2 pm: | "Reserved 请不要在公共场所放屁" | As an example of multilingual capability. |

The ease of use of the present system (99) provides many benefits for vehicle operators (127) that want to use the parking system (99) on a pay for parking basis. Assuming the user (152) has already registered their vehicle (104) (required only once), there are no other activities required—no need for tablets, phones, or computers, no key-pads to enter numbers into, and no need to reserve in advance. The vehicle operator (127) drives into any available space (105), and the system (99) immediately recognizes the vehicle (104), and displays a customized welcome message (151) on the display device (100), indicating that the vehicle (104) has been recognized by the parking system (99). At that point, billing starts, and when the vehicle operator (127) returns back to her vehicle (104) and leaves, an invoice is sent to the registered vehicle owner (which may be different from the vehicle operator (127)), and the parking amount is automatically charged to the registered debit or credit card. The operator (127) does not need to go back to re-plug the meter. Billing can be done by the minute. If the vehicle (104) exceeds its allotted reservation time, the vehicle operator (127) is simply billed for the additional minutes parked. To avoid issues with parking disputes, the emailed invoice can contain a time stamped picture of the vehicle (104) entering the parking space (105), and a time stamped picture of the vehicle (104) exiting the parking space (105), plus an itemization of what taxes were applied.

Using the parking space (105) for reserved parking may be only slightly more complicated than for pay parking. The user (152) must initiate an action to reserve a parking space (105), and pay in advance for that privilege. Other than that, the parking actions are similar—a difference being that at the time of reservation, there is now a reserved parking space (105) with the vehicle operator's name or license plate displayed on it. If the vehicle (104) arrives at the destination before the start of the reservation period, the parking system (99) will still recognize the vehicle (104), and will charge an agreed upon amount for the minutes parked. If the vehicle (104) extends its stay beyond the reservation time amount, the parking space (105) reverts back to pay for parking, and the vehicle operator (127) is charged an agreed amount for the additional minutes parked. If the vehicle operator (127) cannot find the reserved parking designated space (105), all they have to do is pull into any available pay parking space (105), and the system (99) will automatically re-configure itself.

If at the time of parking, the parking space (105) is reserved for another vehicle (104), the dynamically updatable display device (100) will inform the vehicle operator (127) of that fact. If the vehicle operator (127) is not recognized, that too will be displayed. If there is a possible parking infraction, the parking system will inform an authorized agent, and remedial action can be taken—such as a quick human review of the license plate image, or the dispatching of a tow-truck. Because parking violators are clearly identified by the information on the display device (100), there should be no confusion as to what vehicles are causing an infraction.

Because the parking system (99) is self-monitoring, there is no need for the parking space manager (128) to hire and use expensive enforcement personnel to patrol the parking area (106). People that normally park and do not pay are now captured by the system (99) and billed. Because vehicle operators (127) must register in order to use the parking space (105), a contract can be established that supports charging for, and collecting parking revenues. Failure to adhere to the contract rules results in that person no longer being accepted as a customer.

The application that drives the other features and benefits of the present system (99) is the Internet connected reservation system. In order to use the reservation system, the user (152) must first register himself with the system (99) (FIG. 6). By using the reserved parking feature once, the user is made known to the system, and the user becomes familiar with how the system works. If at some future point the user is looking for a parking space (105), and sees an available 'reserved for registered users' parking space display (100), he can park in that space (105) with the same ease of use of reserved parking, but in this case, with no need to set up a reservation. In addition, now that the system (99) recognizes registered vehicles (104), the lot owner can encourage customer loyalty by offering various promotions that encourage additional parking, such as volume discounts, unlimited weekend passes, or loyalty points that can be used for other uses.

The above examples represent only a subset of possible embodiments and uses for the parking space management system (99). The scope of the following appended claims and claims hereafter introduced should not be limited by the embodiments set forth in the examples, but should be given the broadest interpretation consistent with the description as a whole.

What is claimed is:

1. A parking space management system for managing use of a parking area comprising at least one parking space, said parking space management system comprising:

a) One or more database repositories containing: a first database storing vehicle identification information uniquely identifying vehicles authorized to occupy said at least one parking space; and a second database storing parking usage rules governing use of said at least one parking space;

b) A parking space monitor comprising a vehicle detection and recognition system responsive to the presence of a vehicle in a parking space of said at least one parking space in said parking area for collecting information relating to the identity of said vehicle;

c) A dynamically updatable display device visible to a vehicle operator at or near said parking space and associated with said parking space; and d) A computer subsystem which processes input from said parking space monitor and said first and second databases and generates output specific to said vehicle for display on said display device.

2. The parking space management system of claim 1, wherein said dynamically updatable display device is a programmable LED display device.

3. The parking space management system of claim 1, wherein said dynamically updatable display device is an LCD display monitor.

4. The parking space management system of claim 1, wherein said vehicle detection and recognition system comprises a detector selected from the group consisting of a license plate recognition system (LPR), an automatic number plate recognition system (ANPR), an image capture device, a RFID reader, a Bluetooth communication device, a WiFi communication device, a QR Code identification system, a barcode identification system, a vehicle profile recognition system and a vehicle color recognition system.

5. The parking space management system of claim 1, wherein said computer subsystem comprises a vehicle identification subsystem capable of identifying said vehicle based on input received from said parking space monitor, wherein said vehicle identification subsystem is selected from the group consisting of a license plate recognition system (LPR), an automatic number plate recognition system (ANPR), a QR Code identification system, a Barcode identification system, a vehicle profile recognition system, and a vehicle color recognition system.

6. The parking space management system of claim 1, wherein said parking space monitor includes the ability to illuminate at least part of the parking area with visible light, or invisible infrared light.

7. The parking space management system of claim 1, wherein said parking space monitor comprises one or more image capture devices for capturing images of said vehicle and said parking space.

8. The parking space management system of claim 7, comprising an image repository for storing images of said vehicle and said parking space captured by said parking space monitor.

9. The parking space management system of claim 1, further comprising one or more security cameras and associated hardware and software.

10. The parking space management system of claim 9, comprising an image repository for storing images captured by said one or more security cameras.

11. The parking space management system of claim 9, wherein said one or more security cameras enable an authorized agent to view said vehicle and said parking space from an external Internet connection.

12. The parking space management system of claim 1, comprising one or more electronic proximity detectors and associated hardware and software, that can be used by the said parking space monitor to help determine if there is a vehicle parked in said parking space.

13. The parking space management system of claim 1, comprising an electronic motion detector system and associated hardware and software, used by the said parking space monitor to identify if there is a vehicle entering or leaving said parking space.

14. The parking space management system of claim 1, wherein the output displayed on said display device is in a language determined by a vehicle preference setting stored in said one or more database repositories.

15. The parking space management system of claim 1, wherein a database for storing time-of-day parking space usage information including identification information of vehicles entering and exiting said parking space is stored in said one or more database repositories.

16. The parking space management system of claim 15, comprising a billing and payment module that integrates with the information in said one or more database repositories to control billing and payment activities relating to said parking space.

17. The parking space management system of claim 16, wherein the billing and payment module is configured to electronically issue a city parking violation ticket to the owner of a vehicle that is illegally parked in said parking space.

18. The parking space management system of claim 16, wherein said billing and payment module is configured to bill the owner of a vehicle identified as parked in said parking space, a parking fee based on parking space usage information.

19. The parking space management system of claim 16, wherein said billing and payment module is configured to electronically remit a portion of the revenue collected from vehicles which have parked in said parking space, back to the owner of said parking space.

20. The parking space management system of claim 16, wherein said billing and payment module is configured to electronically remit taxes collected from revenues collected from vehicles which have parked in said parking space to the appropriate government agencies.

21. The parking space management system of claim 1, comprising an integrated notification module capable of sending a parking status event notification to one or more of:

a) The owner of said vehicle;

b) One or more authorized parking attendants;

c) The owner of said parking space;

d) The authorized billing service agent for said parking space; and e) A tow truck company.

22. The parking space management system of claim 21, wherein said integrated notification module is configured to send said status event notification via a wireless instant message.

23. The parking space management system of claim 21, wherein said integrated notification module is configured to send said status event notification via an Internet based email.

24. The parking space management system of claim 21, wherein said integrated notification module is configured to send said status event notification via a recorded voice message.

25. The parking space management system of claim 21 wherein said integrated notification module is configured to send said status event notification via a message displayed on said dynamically updatable display device viewable at said parking space.

26. The parking space management system of claim 1, wherein said second database defines and stores a plurality of parking space parameters comprising pre-defined recognized group types for different classes of parking visitors.

27. The parking space management system of claim 1, wherein said one or more database repositories are stored locally to said computer subsystem.

28. The parking space management system of claim 1, wherein at least a portion of said one or more database repositories are stored externally of said computer subsystem in a separate network or Internet accessible computer.

29. The parking space management system of claim 1, wherein at least a portion of said one or more database repositories are stored externally of said computer subsystem in a separate Internet accessible cloud storage.

30. The parking space management system of claim 1, comprising a computer-implemented user interface for said computer subsystem provided on a network connected device.

31. The parking space management system of claim 1, comprising a computer-implemented user interface for said computer subsystem provided over an Internet connected device.

32. The parking space management system of claim 1, comprising a computer-implemented user interface for said computer subsystem provided over a wireless Internet connected device.

33. The parking space management system of claim 1, comprising a computer-implemented user interface for said computer subsystem, configured to permit an authorized agent to update vehicle identity parameters or parking space parameters entered into said first or second databases.

34. The parking space management system of claim 1, wherein said computer subsystem is located in said parking area.

35. The parking space management system of claim 1, wherein said computer subsystem is located in the vicinity of said parking area, and is connected to said dynamically updatable display device and optionally said parking space monitor associated with said parking space by a wired or wireless network connection.

36. The parking space management system of claim 1, wherein said computer subsystem is located remotely from said parking area, and is connected to said dynamically updatable display device and optionally said parking space monitor associated with said parking space by a wired or wireless Internet connection.

37. The parking space management system of claim 1, wherein said computer subsystem is connected to at least one other parking space management system.

38. The parking space management system of claim 1, wherein said vehicle detection and recognition system automatically recognizes the identity of said vehicle without the need for human intervention.

39. A computer-implemented method for automated management of a parking space in a parking area, comprising the steps of:

a) Determining by a parking space monitor equipped with a vehicle detection and recognition system an identity of a vehicle parked in said parking space;

b) Using a computer system, comparing the recognized vehicle identity against a list of known vehicle identities that are explicitly allowed, or explicitly not allowed, to park in said parking space during defined times in the day; and c) Updating a parking space display device to provide real-time feedback to a vehicle operator regarding a vehicle parking status, including a display of personalized messages or images that are matched to the vehicle identity.

40. The method of claim 39, comprising:

a) Updating a database containing parking space availability time slots for the hour, day, month and year to set parking space usage parameters and billing rate parameters in response to instructions received through a computer-implemented user interface;

b) Generating a list of vehicle identities that are recognized by said system in response to instructions received through said computer-implemented user interface;

c) Identifying registered vehicle identities that may park in said parking space during said time slots in response to instructions received through the computer-implemented user interface; and d) Defining custom message text and graphics to be sent to said parking space display device for each of a defined set of recognized event types and vehicle identities in response to instructions received through said computer-implemented user interface.

41. The method of claim 40, comprising sending a notification to one or more appropriate agents if a vehicle is in violation of said parking space usage parameters.

42. The method of claim 41, where one of said notified agents is a tow truck dispatch operator, who is instructed to remove the vehicle that has been deemed to be in violation of said parking space usage parameters.

43. The method of claim 41, where one of said notified agents is a city ticketing office, empowered to issue and collect money for parking violation tickets.

44. The method of claim 41, comprising:

a) Determining the time of usage information for said vehicle parked in said parking space;

b) Matching said vehicle identity with a list of known identities to determine the appropriate group or groups that said vehicle belongs to;

c) Looking up the group information in the available parking usage database to determine the billing rate for said parking space during an occupied time period;

d) Looking up the billing information for said identified vehicle, and billing the owner of said identified vehicle for the time parked;

e) Remitting the agreed upon percentage or cut of the revenue to said parking space owner; and f) Remitting the legally defined amount of the parking revenue to each of the various government tax authorities.

45. A computer-implemented method for managing at least one parking space, the method comprising:

receiving, from a parking space monitor equipped with a vehicle detection and recognition system, information to identify a vehicle parked in said at least one parking space;

determining by a computer system the identity of said vehicle based on the information received from the parking space monitor;

determining by a computer system whether the parked vehicle is authorized to park in said parking space based on the identity of said vehicle and a set of parking usage rules for said parking space;

if the parking is authorized, the computer system transmitting a first message indicating an authorized parking state to a dynamically updatable display panel located in view of an operator of said vehicle; and if the parking is unauthorized, the computer system transmitting to said display panel a second message indicating an unauthorized parking state.

46. A system for managing a parking space, the system comprising:

a parking space monitor equipped with a vehicle detection and recognition system for obtaining information for identifying a vehicle parked in said parking space;

a dynamically updatable display panel located in view of an operator of said vehicle; and a computer subsystem configured to:

receive information from said parking space monitor and determine an identity of said vehicle based on said information;

determine whether said vehicle is authorized to park in said parking space based on the vehicle identity and a set of parking usage rules for said parking space;

if the parking is authorized, transmit a first message indicating an authorized parking state to said display panel; and if the parking is unauthorized, transmit a second message to said display panel indicating an unauthorized parking state.

47. The system of claim 46, wherein the vehicle detection and recognition system comprises a detector selected from the group consisting of a license plate recognition system (LPR), an automatic number plate recognition system (ANPR), an image capture device, a RFID reader, a Bluetooth communication device, a WiFi communication device, a QR Code identification system, a barcode identification system, a vehicle profile recognition system and a vehicle color recognition system.

48. The system of claim 46, wherein the computer subsystem is configured to:

receive a request to register a vehicle with the system, the registration request associated with a vehicle license plate number and a vehicle group; and add the vehicle license plate number to the vehicle group in a vehicle registration database.

49. The system of claim 46, wherein the computer subsystem is configured to:

receive a request to reserve said parking space, the reservation request associated with a vehicle license plate number and a requested time period; and if said parking space is available for the requested time period, update the parking usage rules for said parking space by allocating said parking space for the requested time period for a vehicle associated with the vehicle license plate number.

50. The system of claim 46, wherein said computer subsystem is configured to receive input from one or more database repositories containing a first database storing vehicle identification information uniquely identifying vehicles authorized to occupy said parking space and a second database storing parking usage rules governing use of said parking space.

* * * * *